US010420393B2

(12) United States Patent
Saito et al.

(10) Patent No.: US 10,420,393 B2
(45) Date of Patent: Sep. 24, 2019

(54) FOOTWEAR SHEET AND FOOTWEAR

(71) Applicant: Uchida Hanbai System, Ltd., Iwate (JP)

(72) Inventors: Tatsuo Saito, Iwate (JP); Hiroko Uchida, Iwate (JP)

(73) Assignees: Uchida Hanbai System, Ltd., Iwate (JP); Tatsuo Saito, Iwate (JP); Hiroko Uchida, Iwate (JP)

( * ) Notice: Subject to any disclaimer, the term of this patent is extended or adjusted under 35 U.S.C. 154(b) by 480 days.

(21) Appl. No.: 14/416,925

(22) PCT Filed: Jul. 25, 2013

(86) PCT No.: PCT/JP2013/070157
§ 371 (c)(1),
(2) Date: Jan. 23, 2015

(87) PCT Pub. No.: WO2014/017581
PCT Pub. Date: Jan. 30, 2014

(65) Prior Publication Data

US 2015/0173457 A1 Jun. 25, 2015

(30) Foreign Application Priority Data

Jul. 26, 2012 (JP) ..... 2012-179945
Aug. 9, 2012 (JP) ..... 2012-185844
Nov. 7, 2012 (JP) ..... 2012-256821

(51) Int. Cl.
*A43B 13/40* (2006.01)
*A43B 7/14* (2006.01)
*A43B 13/38* (2006.01)

(52) U.S. Cl.
CPC ..... *A43B 13/40* (2013.01); *A43B 7/143* (2013.01); *A43B 7/144* (2013.01); *A43B 7/149* (2013.01);

(Continued)

(58) Field of Classification Search
CPC ..... A43B 7/149; A43B 7/1445; A43B 7/1465; A43B 7/143

(Continued)

(56) References Cited

U.S. PATENT DOCUMENTS 4,112,599 A * 9/1978 Krippelz ..... A43B 13/20 36/11.5
4,316,333 A * 2/1982 Rothschild ..... A43B 7/142 36/50.1

(Continued)

FOREIGN PATENT DOCUMENTS

CN 1284839 A 2/2001
CN 101351132 A 1/2009

(Continued)

OTHER PUBLICATIONS

The State Intellectual Property Office of the People's Republic of China; The Second Office Action; dated Jul. 15, 2016; 7 pages.

*Primary Examiner* — Megan E Lynch
(74) *Attorney, Agent, or Firm* — Reinhart Boerner Van Deuren P.C.

(57) ABSTRACT

[Technical Problem]
To provide a footwear sheet and a footwear that can increase the efficiency at which a user trains to be able to assume an ideal posture.
[Solution to Problem]
A footwear sheet 30 to be in contact with the sole surface of a wearer wearing a footwear 1, including: a sheet-like base part 40; and a pressure-applying part 50 projected from a side surface of the base part 40, the pressure-applying part 50 being formed in a planar shape smaller than that of the sole surface of the wearer, wherein the pressure-applying part 30 is provided on an opposite-side surface that is a side surface of the side surfaces of the base part 40 opposite a sole-side surface, the pressure-applying part 50 being indi- (Continued)

rectly in contact with a portion of the sole surface of the wearer with the base part 40 in between such that pressure on the portion of the sole surface of the wearer is higher than pressure on the other portion, enabling the shape of the sole surface of the wearer to be corrected so that the shape of the sole surface of the wearer follows the shape of the pressure-applying part 50.

4 Claims, 17 Drawing Sheets

(52) U.S. Cl.
CPC ..... *A43B 7/1415* (2013.01); *A43B 7/1445* (2013.01); *A43B 13/386* (2013.01)

(58) Field of Classification Search
USPC ..... 36/43, 44
See application file for complete search history.

(56) References Cited

U.S. PATENT DOCUMENTS 4,316,335 A * 2/1982 Giese ..... A43B 5/00 36/129
4,694,590 A * 9/1987 Greenawalt ..... A43B 7/1415 36/163
4,999,931 A * 3/1991 Vermeulen ..... A43B 13/185 36/153
5,365,678 A * 11/1994 Shibata ..... A43B 17/03 36/141
5,388,351 A * 2/1995 Mitchell ..... A43B 7/142 36/145
5,799,415 A * 9/1998 Kenji ..... A43B 17/08 36/3 R
5,894,687 A * 4/1999 Lin ..... A43B 7/146 36/141
5,921,009 A * 7/1999 Hice ..... A43B 13/143 36/140
6,141,890 A * 11/2000 Chtn ..... A43B 3/12 36/141
7,832,119 B2 * 11/2010 Gilmore ..... A61F 5/14 36/143
8,914,998 B2 * 12/2014 Gheorghian ..... A43B 5/06 36/103
2002/0014024 A1 * 2/2002 Gardiner ..... A43B 7/141 36/155
2004/0255488 A1 * 12/2004 Brooks ..... A43B 7/1415 36/44
2006/0000120 A1 * 1/2006 Chenut ..... A43B 7/142 36/144
2006/0026867 A1 2/2006 Polcek
2006/0059726 A1 * 3/2006 Song ..... A43B 7/142 36/142
2006/0080863 A1 * 4/2006 Pai ..... A43B 7/1415 36/30 R
2006/0207123 A1 * 9/2006 Milner ..... A43B 1/0045 36/44
2007/0079532 A1 * 4/2007 Ramirez ..... A43B 7/1415 36/140
2007/0186446 A1 * 8/2007 Lafortune ..... A43B 7/142 36/43
2007/0227044 A1 * 10/2007 Maxson ..... A43B 1/0027 36/44
2007/0294922 A1 * 12/2007 Ma ..... A43B 7/144 36/142
2008/0127515 A1 * 6/2008 Lohrer ..... A43B 7/1415 36/88
2009/0038180 A1 * 2/2009 Jacob ..... A43B 1/0054 36/44
2009/0293307 A1 * 12/2009 Koyama ..... A43B 7/142 36/88
2010/0132222 A1 * 6/2010 Kawahara ..... A43B 7/142 36/91
2010/0180467 A1 * 7/2010 Singleton ..... A43B 7/141 36/88
2011/0061266 A1 * 3/2011 Hsieh ..... A43B 7/141 36/107
2011/0099842 A1 * 5/2011 Burke ..... A43B 7/142 36/44
2011/0289798 A1 * 12/2011 Jung ..... A43B 7/142 36/91
2011/0302806 A1 * 12/2011 Auger ..... A43B 7/1445 36/44
2012/0066937 A1 * 3/2012 Chang ..... A43B 17/08 36/3 B
2012/0233881 A1 * 9/2012 Orien ..... A43B 7/142 36/44
2013/0008050 A1 * 1/2013 Marc ..... A43B 17/026 36/44
2013/0019499 A1 * 1/2013 Hsu ..... A43B 17/023 36/44
2013/0111781 A1 * 5/2013 Jaeger ..... A43B 3/0052 36/43
2013/0160331 A1 * 6/2013 Burke ..... A43B 1/0081 36/25 R
2013/0174444 A1 * 7/2013 Jacobs ..... A43B 5/12 36/28
2013/0199056 A1 * 8/2013 Lim ..... A43B 7/146 36/43
2013/0318818 A1 * 12/2013 Gardiner ..... A43B 7/141 36/43

FOREIGN PATENT DOCUMENTS

DE 88 15 539 U1 2/1989
FR 761406 A 10/1933
FR 2 757 024 A1 6/1998
JP 2000-189204 7/2000
JP 2000189204 A 7/2000
JP 2008-307352 12/2008
JP 2009-017938 1/2009
JP 2010-125100 6/2010
JP 3175544 5/2012
JP 2012-120760 6/2012
TW 200727881 A 8/2007

* cited by examiner

FOOTWEAR SHEET AND FOOTWEAR

TECHNICAL FIELD

The present invention relates to a footwear sheet and a footwear.

BACKGROUND ART

Conventionally, a footwear having a balancing exercising element has been proposed as a footwear used for training for sports or the like (for example, see Patent Document 1). The balancing exercising element is formed in a square rod-like body and provided on the bottom surface of the footwear. A user wearing such a footwear, in order to maintain his/her own balance, needs to shift his/her weight in a way different from that without the balancing exercising element, which allows the user to learn an appropriate way of shifting his/her weight.

PRIOR ART DOCUMENT

Patent Document

[Patent Document 1] JP-A-2012-120760

SUMMARY OF INVENTION

Technical Problem

It is an object of the present invention to solve the problems of the above mentioned prior arts.

Solution to Problem

One aspect of the present invention provides a footwear sheet to be in contact with the sole surface of a wearer wearing a footwear, including: a sheet-like base part; and a pressure-applying part projected from a side surface of the base part, the pressure-applying part being formed in a planar shape smaller than that of the sole surface of the wearer, wherein the pressure-applying part is provided on a sole-side surface that is a side surface of the side surfaces of the base part facing the sole surface of the wearer, the pressure-applying part being directly in contact with a portion of the sole surface of the wearer such that pressure on the portion of the sole surface of the wearer is higher than pressure on the other portion, enabling the shape of the sole surface of the wearer to be corrected so that the shape of the sole surface of the wearer follows the shape of the pressure-applying part, or is provided on an opposite-side surface that is a side surface of the side surfaces of the base part opposite the sole-side surface, the pressure-applying part being indirectly in contact with a portion of the sole surface of the wearer with the base part in between such that pressure on the portion of the sole surface of the wearer is higher than pressure on the other portion, enabling the shape of the sole surface of the wearer to be corrected so that the shape of the sole surface of the wearer follows the shape of the pressure-applying part.

MODE FOR CARRYING OUT THE INVENTION

Embodiments of a footwear sheet and a footwear in accordance with the invention is described below in detail with reference to the drawings. However, the invention is not limited by the embodiments.

Concept Common to Embodiments

First, a concept common to the embodiments in accordance with the invention is described. The embodiments relate to a footwear sheet and a footwear to be in contact with the sole surface of a wearer wearing the footwear.

Here, among side surfaces of a foot of the wearer, the "sole surface of the wearer" refers to the bottom side surface of the foot. Further, among parts of the body in a standing position, the "foot" refers to a part located below the sole surface-side end of a tibia which is a bone having an ankle. Hereinafter, the details of the sole surface of the wearer, in particular, bones and tendons relating to the sole surface of the wearer are described.

Figure 1:
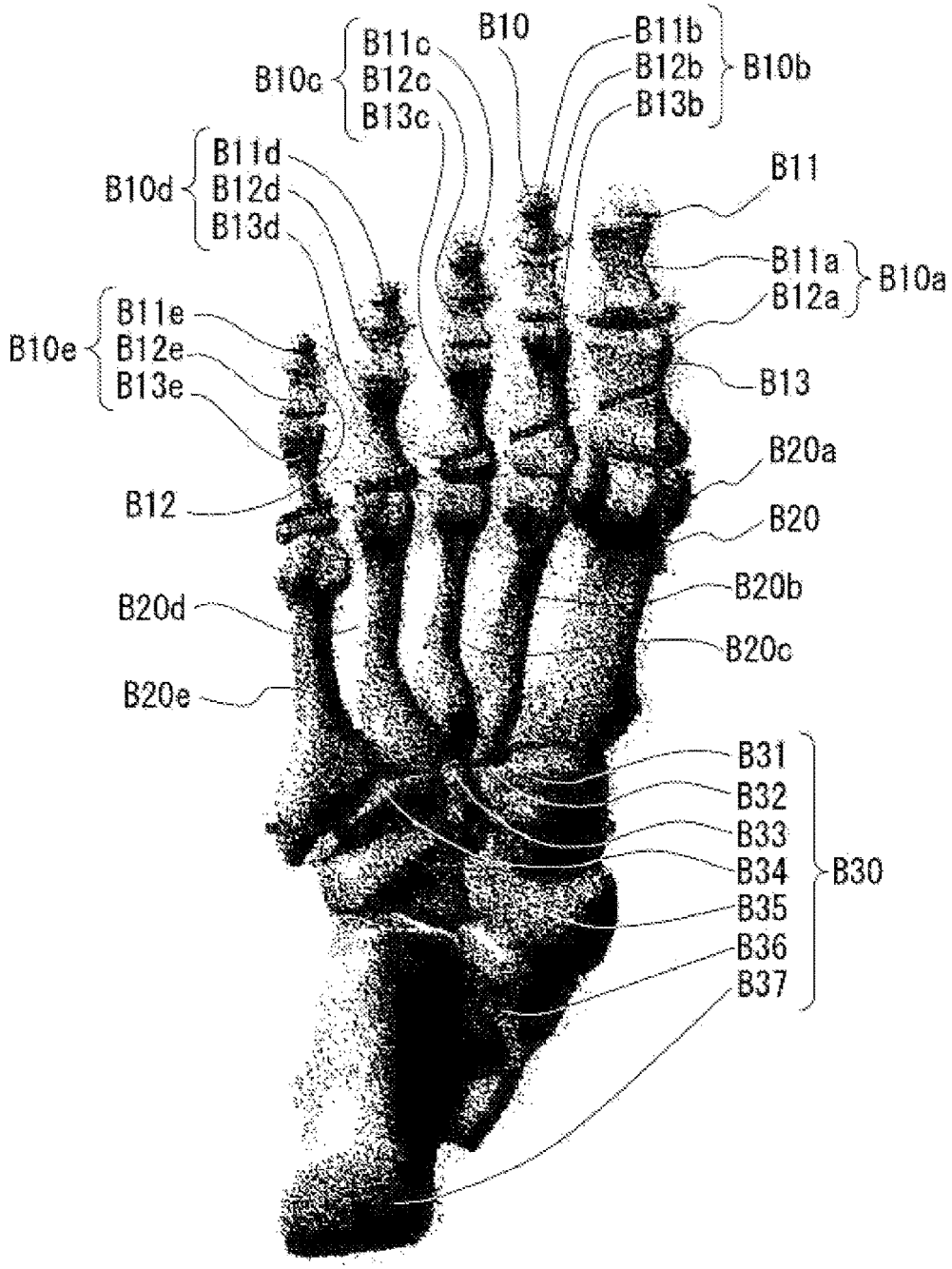
FIG. 1 shows an overview of bones of a foot.

First, bones relating to the sole surface of the wearer are described. FIG. 1 shows an overview of bones of a foot. As shown in FIG. 1, bones relating to the sole surface of the wearer include a "phalanx B10," a "metatarsal B20" and a "tarsal B30."

Among them, the "phalanx B10" is a bone located at the toe of the foot. Specifically, a phalanx B10 corresponding to the big toe (what is called the thumb of the foot) includes: a distal phalanx B11 located at the tip; and a proximal phalanx B13 connected to the distal phalanx B11 via a joint. Further, a phalanx B10 corresponding to toes other than the big toe includes: a distal phalanx B11; a middle phalanx B12 connected to the distal phalanx B11 via a joint; and a proximal phalanx B13 connected to the middle phalanx B12 via a joint. Note that the phalanxes B10 corresponding to the big toe to the smallest toe are referred to as the first phalanx B10*a* to the fifth phalanx B10*e* in this order (this also applies to the distal phalanxes B11 from the first distal phalanxes B11 a to the fifth distal phalanxes B11*e*, the middle phalanxes B12 from the second middle phalanxes B12*b* to the fifth middle phalanxes B12*e*, the proximal phalanxes B13 from the first proximal phalanxes B13*a* to the fifth proximal phalanxes B13*e*, and the metatarsals B20 from the first metatarsal B20*a* to the fifth metatarsal B20*e*). Further, the "metatarsal B20" is a bone located between the phalanx B10 and the tarsal B30 and connected to the phalanx B10 via a joint. That is, the number of the metatarsals B20 corresponds with that of the phalanxes B10. Further, bones located between the metatarsals B20 and the tibia not shown are collectively referred to as the "tarsal B30." Specifically, the tarsal B30 includes: a medial cuneiform bone B31 connected to the first metatarsal B20*a* via a joint; an intermediate cuneiform bone B32 connected to the second metatarsal B20*b* via a joint; an external cuneiform bone B33 connected to the third metatarsal B20*c* via a joint; a cuboid bone B34 connected to the fourth metatarsal B20*d* and the fifth metatarsal B20*e* via a joint; a navicular bone B35 connected to the medial cuneiform bone B31, the intermediate cuneiform bone B32, the external cuneiform bone B33 and the cuboid bone B34 via a joint; an ankle bone B36 connected to the navicular bone B35 via a joint (what is called a tarsal navicular joint); and a calcaneal bone B37 connected to the cuboid bone B34 via a joint (what is called a calcaneocuboid joint) (note that the joints consisting of the tarsal navicular joint and the calcaneocuboid joint are referred to as a Chopart's joint).

Figure 2:
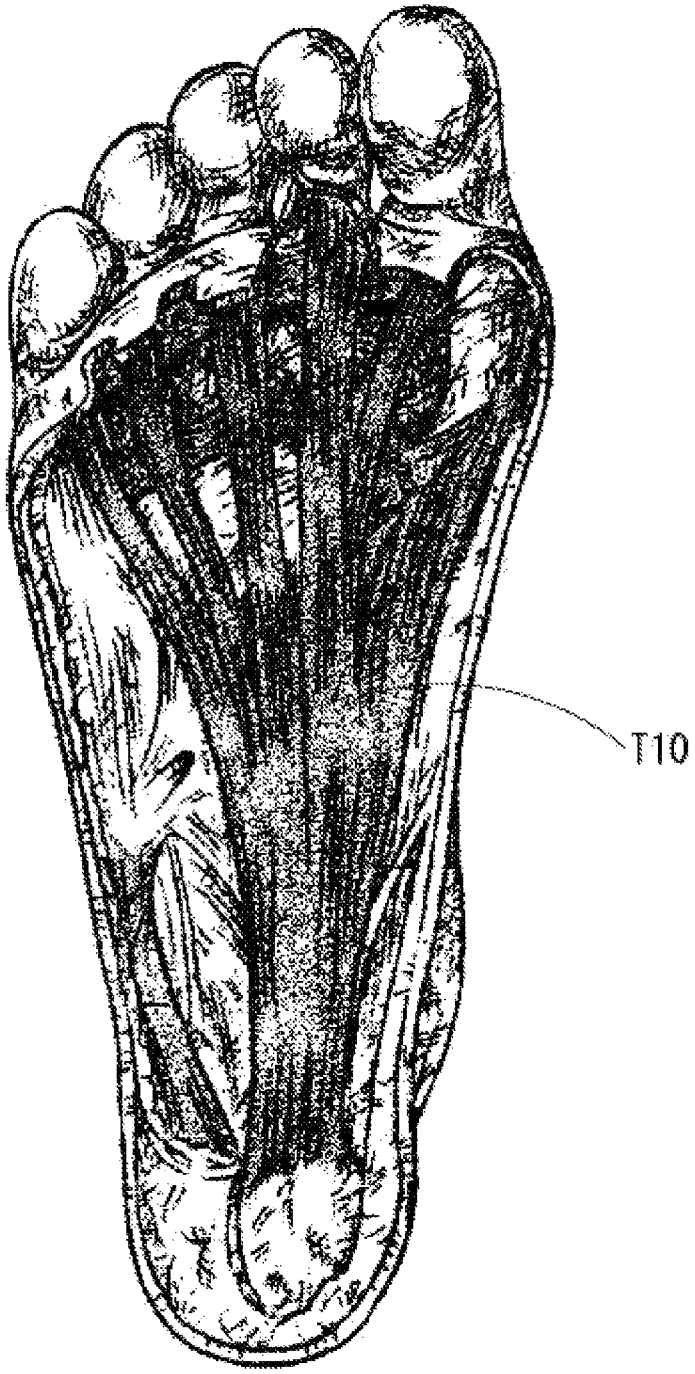
FIG. 2 shows an overview of tendons of the sole surface.

Next, tendons of the foot relating to the sole surface of the wearer are described. FIG. 2 shows an overview of tendons of the sole surface. As shown in FIG. 2, the tendons of the foot relating to the sole surface of the wearer include a "plantar aponeurosis T10 (plantar fascia)," for example. The "plantar aponeurosis T10" is a thin film-like tendon formed to spread out in a fan-like form in the sole surface from a portion corresponding to the calcaneal bone B37 of the tarsal B30 to a portion corresponding to the phalanx B10-side end from the first metatarsal B20*a* to the fifth metatarsal B20*e*.

In the embodiments, generally, a portion of the footwear sheet is caused to be directly or indirectly in contact with a portion of the sole surface of the wearer, causing the pressure on the portion of the sole surface of the wearer to be higher than the pressure on the other portion, to enable the shape of the sole surface of the wearer to be corrected so that it follows the shape of the portion of the footwear sheet.

Further, in the description below, the footwear sheet is applied to shoes (such as men's shoes, ladies' shoes, sports shoes, leather shoes, etc.). However, the footwear sheet may also be applied to a footwear other than described above, such as high heels, sandals, slippers, zori sandals or geta sandals.

First Embodiment

First, a first embodiment is described. This embodiment includes a pressure-applying part having a plantar aponeurosis pressure-applying portion.

(Configuration)

Figure 3:
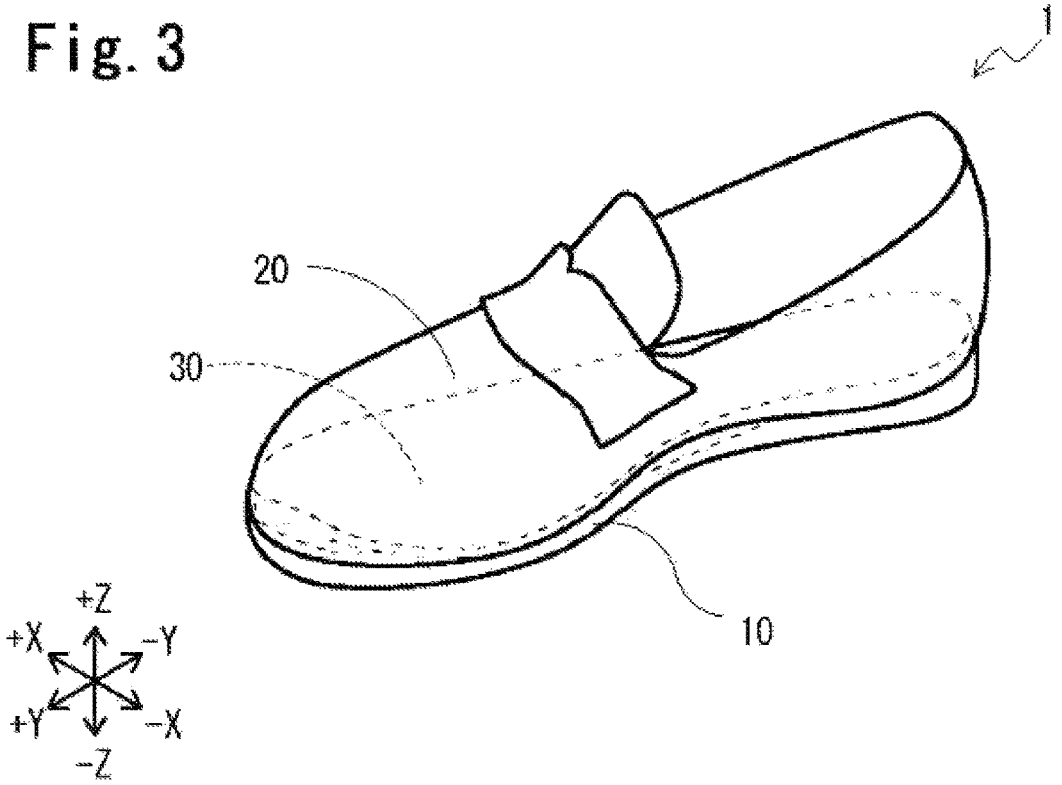
FIG. 3 is a perspective view showing an overview of a footwear in accordance with a first embodiment.

First, the configuration of a footwear in accordance with the first embodiment is described. FIG. 3 is a perspective view showing an overview of the footwear in accordance with the first embodiment. The footwear shown in FIG. 3 is for the right foot. Note that, in the following description, the X direction in FIG. 3 indicates the outward-inward direction, the Y direction in FIG. 3 indicates the forward-backward direction, and the Z direction in FIG. 3 indicates the upward-downward direction. Further, the plus-X direction in FIG. 3 (shown as "+X") indicates the outward direction, the minus-X direction in FIG. 3 (shown as "−X") indicates the inward direction, the plus-Y direction in FIG. 3 (shown as "+Y") indicates the forward direction, the minus-XY direction in FIG. 3 (shown as "−Y") indicates the backward direction, the plus-Z direction in FIG. 3 (shown as "+Z") indicates the upward direction, and the minus-Z direction in FIG. 3 (shown as "−Z") indicates the downward direction. Note that, for a footwear for the left foot, the indication of the +X direction and the −X direction is reversed. As shown in FIG. 3, a footwear 1 includes a bottom part 10, a cover part 20 and a footwear sheet 30 (insole). Here, between side surfaces of the bottom part 10, a side surface facing the sole surface of the wearer is referred to as a sole-side surface, and a side surface opposite the side surface facing the sole surface of the wearer is referred to as an opposite-side surface (this also applies to side surfaces of the footwear sheet 30, side surfaces of a base part 40 of the footwear sheet 30 described later, and side surfaces of a pressure-applying part 50 of the footwear sheet 30 described later).

(Configuration—Bottom Part)

The bottom part 10 is a support means for supporting the foot of the wearer. As shown in FIG. 3, the bottom part 10 is a sheet-like body having a planar shape generally the same as the shape of the sole surface of the wearer, and is formed of, for example, ethylene vinyl acetate (EVA), polyurethane foam, thermoplastic polyurethane or the like. The sole-side surface of the bottom part 10 is formed to be generally flat. On the other hand, the opposite-side surface of the bottom part 10 is formed to be generally flat on the whole, though the opposite-side surface may have a plurality of bumps and dips having a length in the Z direction shorter than that of the pressure-applying part 50 in order to provide cushioning capability or the like to the footwear 1.

(Configuration—Cover Part)

The cover part 20 is a cover means for covering the side surfaces other than the sole surface among the side surfaces of the foot. As shown in FIG. 3, the cover part 20 is a generally tubular body formed in a shape that can be worn by the foot of the wearer, and is formed of, for example, leather, synthetic resin material such as polyethylene or the like. The cover part 20 is provided on the sole-side surface of the bottom part 10. Then, the lower open edge end of the cover part 20 is joined to the bottom part 10 with an adhesive, a sewing thread or the like.

(Configuration—Footwear Sheet)

Figure 4:
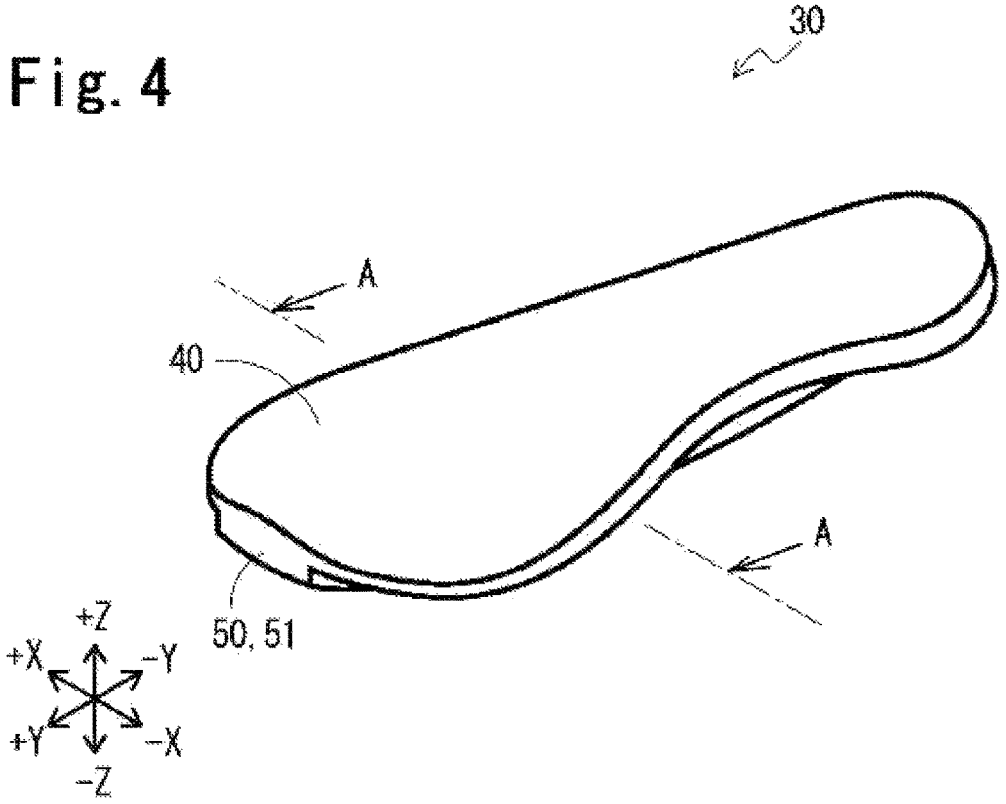
FIG. 4 is a perspective view showing an overview of a footwear sheet in accordance with the first embodiment.
Figure 5:
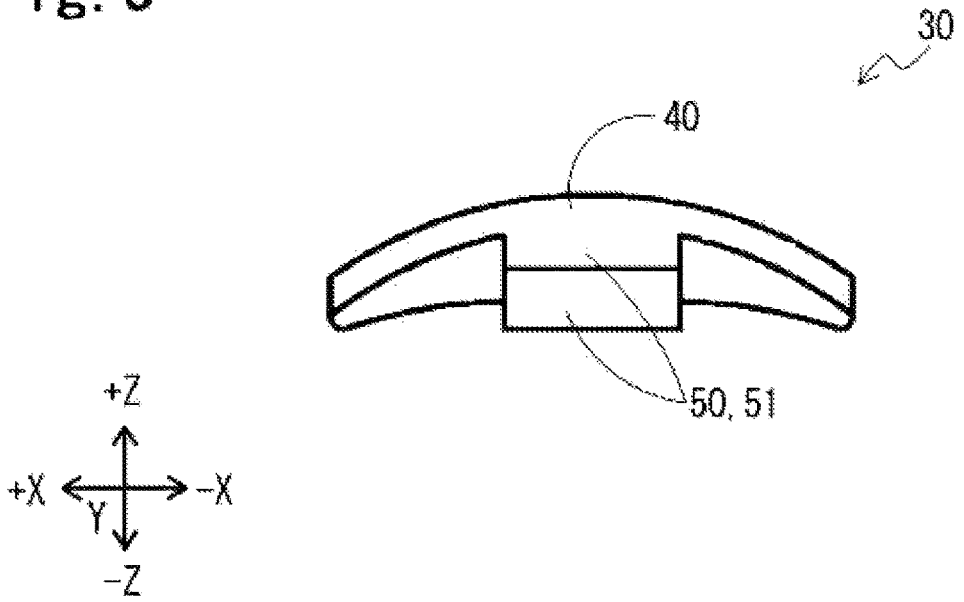
FIG. 5 is a front view showing the footwear sheet in accordance with the first embodiment.
Figure 6:
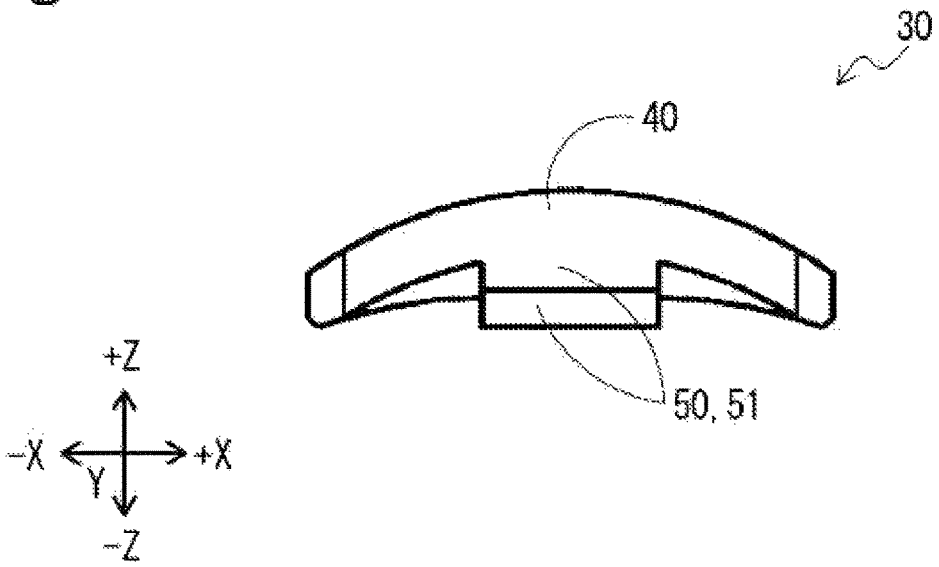
FIG. 6 is a rear view showing the footwear sheet in accordance with the first embodiment.
Figure 7:
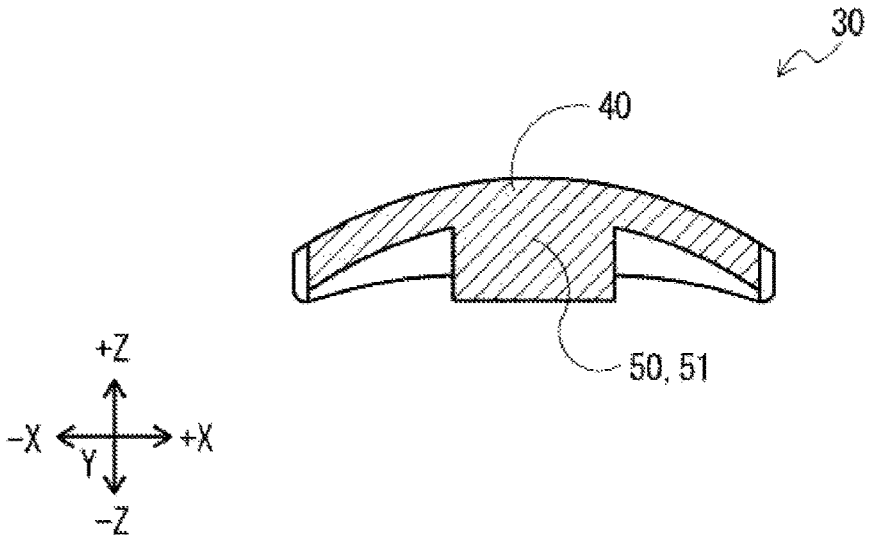
FIG. 7 is an A-A cross-sectional view of the footwear sheet shown in FIG. 4.
Figure 8:
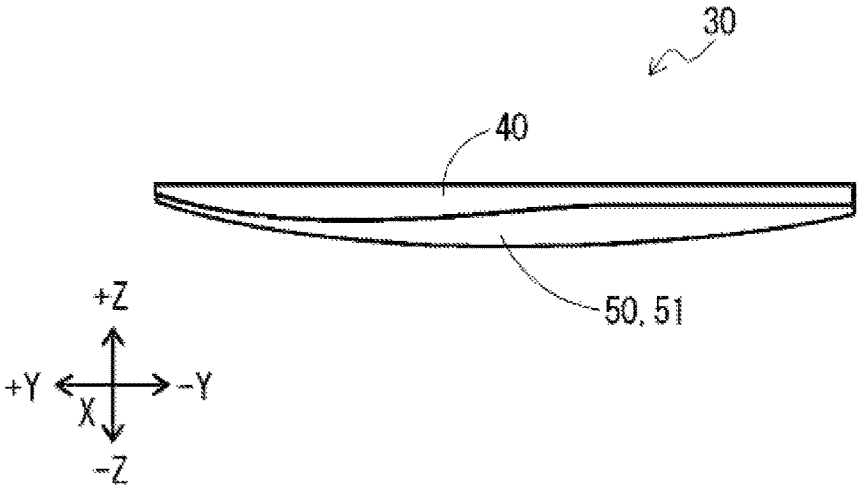
FIG. 8 is a side view showing the footwear sheet in accordance with the first embodiment.
Figure 9:
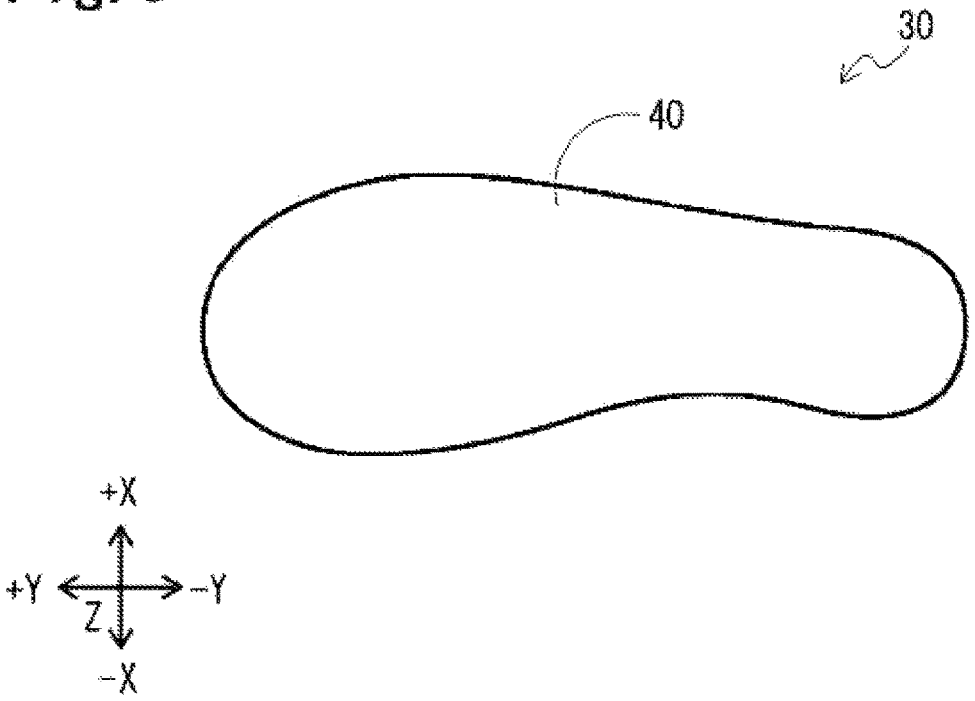
FIG. 9 is a plan view showing the footwear sheet in accordance with the first embodiment.
Figure 10:
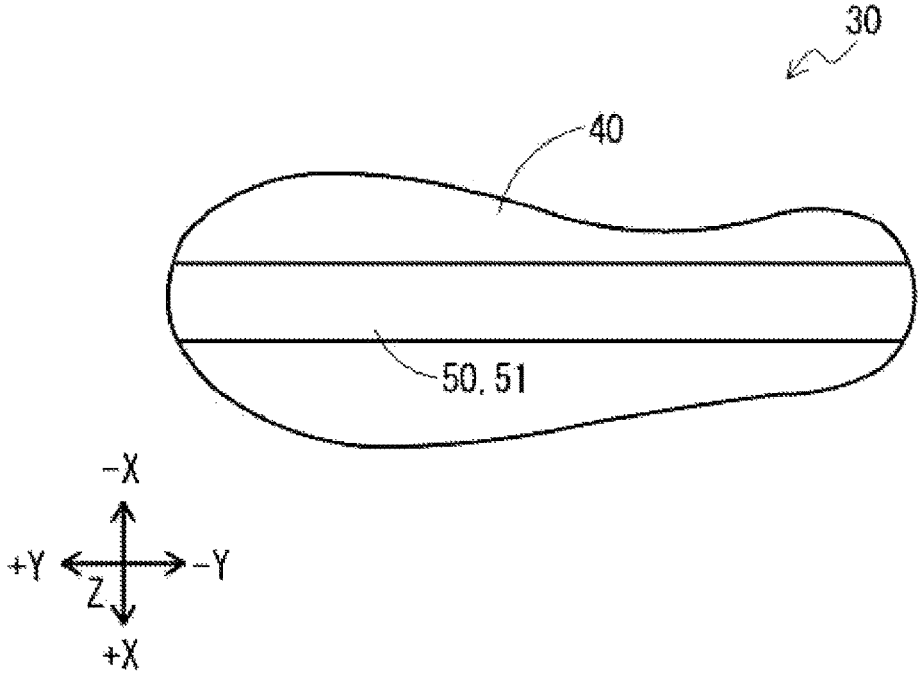
FIG. 10 is a bottom view showing the footwear sheet in accordance with the first embodiment.

FIG. 4 is a perspective view showing an overview of the footwear sheet 30 in accordance with the first embodiment. FIG. 5 is a front view showing the footwear sheet 30 in accordance with the first embodiment. FIG. 6 is a rear view showing the footwear sheet 30 in accordance with the first embodiment. FIG. 7 is an A-A cross-sectional view of the footwear sheet 30 shown in FIG. 4. FIG. 8 is a side view showing the footwear sheet 30 in accordance with the first embodiment. FIG. 9 is a plan view showing the footwear sheet 30 in accordance with the first embodiment. FIG. 10 is a bottom view showing the footwear sheet 30 in accordance with the first embodiment. The footwear sheet 30 is intended to be in contact with the sole surface of the wearer. As shown in FIGS. 4 to 10, the footwear sheet 30 is placed on the sole-side surface of the bottom part 10 (or fixed to the sole-side surface of the bottom part 10 with an adhesive or the like), and includes the base part 40 (insole body) and the pressure-applying part 50 (in a convex shape). The footwear sheet 30 may be formed in any appropriate way, for example, may be formed by integrally molding the base part 40 and the pressure-applying part 50.

(Configuration—Footwear Sheet—Base Part)

The base part 40 is a basic structure of the footwear sheet 30 and is formed in a sheet-like shape as shown in FIGS. 4 to 10.

Here, the detailed shape of the base part 40 is set as follows. Specifically, the planar shape of the base part 40 is set to be generally the same shape as the planar shape of the bottom part 10. Further, the side-surface shape of the base part 40 is set to be in a shape in which the base part 40 is convexly curved (arched) toward the +Z direction so that a portion of the base part 40 corresponding to the plantar aponeurosis T10 of the wearer is located at the highest position in order to improve the fitness between the sole surface of the wearer and the plantar aponeurosis pressure-applying portion of the pressure-applying part described later and facilitate walking such that the toes open inwardly and outwardly to increase the amount of muscular movement around the toes. Further, the length in the Z direction of the base part 40 is set such that, as shown in FIG. 8, a portion of the base part 40 corresponding to the proximal phalanx B13 and the metatarsal B20 of the wearer has a length in the Z direction longer than the length in the Z direction of the other portion in order to reduce the load on a portion of the sole surface of the wearer corresponding to the proximal phalanx B13 and the metatarsal B20. Note that the shape of the base part 40 is not limited to the above described setting and may also be set in any appropriate way depending on the use intended by the wearer.

The base part 40 may be formed of any appropriate material, such as ethylene vinyl acetate, polyurethane foam, thermoplastic polyurethane, natural rubber, synthetic rubber, etc.

Note that the base part 40 may be configured in any appropriate way, and may also be configured in a way as follows, as well as described above. For example, the sole-side surface (curved top surface) of the base part 40 may have a well-known quick drying sheet, a well-known deodorant sheet or a well-known antibacterial sheet, etc. applied thereon. Further, the base part 40 may have a plurality of holes formed therethrough in order to improve breathability and cushioning capability.

(Configuration—Pressure-Applying Part)

The pressure-applying part 50 is intended to apply pressure on at least a portion of the sole surface of the wearer. The pressure-applying part 50 is formed to have a planar shape smaller than the planar shape of the sole surface of the wearer. Further, the pressure-applying part 50 is provided on the opposite-side surface (bottom surface) of the base part 40 and includes a plantar aponeurosis pressure-applying portion 51.

(Configuration—Pressure-Applying Part—Plantar Aponeurosis Pressure-Applying Portion)

The plantar aponeurosis pressure-applying portion 51 is intended to apply pressure on at least a portion of the plantar aponeurosis T10 of the wearer. As shown in FIGS. 8 and 10, the plantar aponeurosis pressure-applying portion 51 is intended to be placed at a position and in a shape such that it can apply pressure on the plantar aponeurosis T10 of the wearer, and is placed in a planar area corresponding to the plantar aponeurosis T10. For example, the plantar aponeurosis pressure-applying portion 51 may be placed so as to correspond to the whole of the planar area corresponding to the plantar aponeurosis T10 or may be placed so as to correspond to only a portion of the planar area corresponding to the plantar aponeurosis T10. However, a portion that does not function substantially as the plantar aponeurosis pressure-applying portion 51 may be projected in the forward-backward direction or outward-inward direction from the planar area corresponding to the plantar aponeurosis T10. For example, if making the length in the Z direction of the front end and the rear end of the plantar aponeurosis pressure-applying portion 51 shorter than the length of the middle portion in the forward-backward direction reduces the pressure applied on the foot by the front end and the rear end, the front end and the rear end is a portion that do not function substantially as the plantar aponeurosis pressure-applying portion 51, so the front end and the rear end may be projected in the forward-backward direction from the planar area corresponding to the plantar aponeurosis T10.

Here, the shape of the plantar aponeurosis pressure-applying portion 51 in the embodiment is described below in detail. Specifically, the plantar aponeurosis pressure-applying portion 51 is formed in an elongated rectangular parallelepiped. More specifically, as shown in FIG. 10, the length in the X direction of the plantar aponeurosis pressure-applying portion 51 is set to generally one fourth of the length in the X direction of the base part 40, and the length in the Y direction of the plantar aponeurosis pressure-applying portion 51 is set to be generally the same as the length in the Y direction of the base part 40. The plantar aponeurosis pressure-applying portion 51 formed in this way is placed in an area corresponding to a portion of the plantar aponeurosis T10 (specifically, a portion from a portion corresponding the calcaneal bone B37 of the tarsal B30 to a portion corresponding to the end on the phalanx B10 side of the second metatarsal B20*b*, and a portion from a portion corresponding the calcaneal bone B37 of the tarsal B30 to a portion corresponding to the end on the phalanx B10 side of the third metatarsal B20*c*). Further, the front end of the plantar aponeurosis pressure-applying portion 51 is projected in the forward direction from the planar area corresponding to the plantar aponeurosis T10, and the rear end of the plantar aponeurosis pressure-applying portion 51 is projected in the backward direction from the planar area corresponding to the plantar aponeurosis T10. However, since the length in the Z direction of the front end and the rear end is longer than the length of the middle portion in the forward-backward direction, the pressure applied on the foot by the front end and the rear end is reduced, so the front end and the rear end is a portion that do not function substantially as the plantar aponeurosis pressure-applying portion 51. Further, the plantar aponeurosis pressure-applying portion 51 may have any appropriate length in the Z direction. However, when the wearer wears the footwear 1, preferably, there is no difference in height between the opposite-side surface of the plantar aponeurosis pressure-applying portion 51 and the opposite-side surface of the base part 40. So, the length in the Z direction of the plantar aponeurosis pressure-applying portion 51 and the length in the outward-inward direction of the base part 40 are set to satisfy such a condition.

Further, as shown in FIG. 8, a portion of the plantar aponeurosis pressure-applying portion 51 corresponding to the neighborhood of the "arch of the foot" of the wearer has a length in the Z direction that is set to be longer than the length in the Z direction of the other portion. Here the "arch of the foot" refers to a portion of the sole surface in which a recess is formed such that the portion will not be in contact with the ground when a person stands up, the portion corresponding to an area including a portion of the first metatarsal B20*a*, a portion of the second metatarsal B20*b* and a portion of the medial cuneiform bone B31, the intermediate cuneiform bone B32, the navicular bone B35 and the calcaneal bone B37. This allows, when the wearer does training such as walking or running, the wearer to walk using the hip joint without putting a load on the knee. This increases the length of stride of the wearer, which can increase the range of motion of the lower body muscles and improve the strength of the lower body muscles. Note that the shape of the plantar aponeurosis pressure-applying portion 51 is not limited to the above described setting, but may also be set in any appropriate way depending on the use intended by the wearer. However, for example, when pressure is applied on the arch of the foot by providing an arch-of-the-foot pressure-applying portion 54 as described later, a portion of the plantar aponeurosis pressure-applying portion 51 corresponding to the neighborhood of the "arch of the foot" may have a length in the Z direction equal to or less than the length in the Z direction of the other portion.

Further, the plantar aponeurosis pressure-applying portion 51 is formed of a material that is, for example, generally the same as or harder than that of the base part 40 (for example, rubber or wood or the like harder than the material of the base part 40) so that pressure can be applied on at least a portion of the plantar aponeurosis T10 of the wearer (this also applies to a joint pressure-applying portion 52 of a second embodiment and the arch-of-the-foot pressure-applying portion 54 of a fifth embodiment, which are described later).

(Function of Footwear Sheet)

Figure 11:
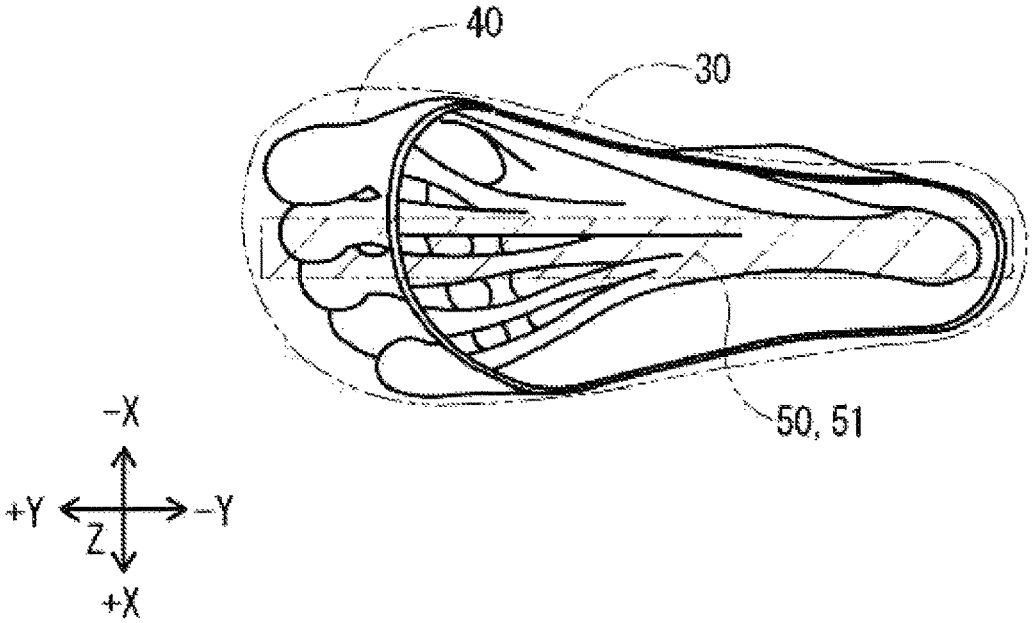
FIG. 11 shows a positional relationship between the sole surface of the wearer and the plantar aponeurosis pressure-applying portion.
Figure 12:
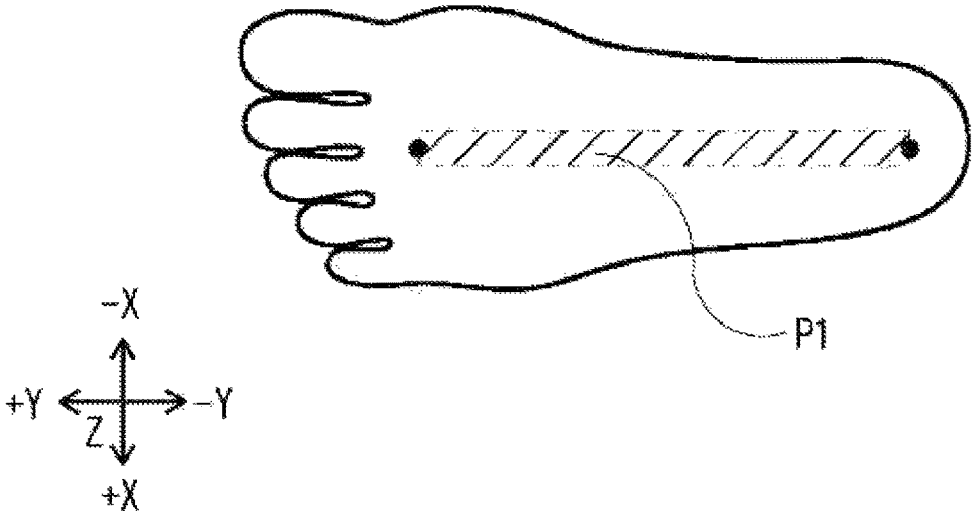
FIG. 12 shows a pressure distribution on the sole surface of the wearer when the footwear sheet is placed on the bottom part of the footwear.
Figure 13:
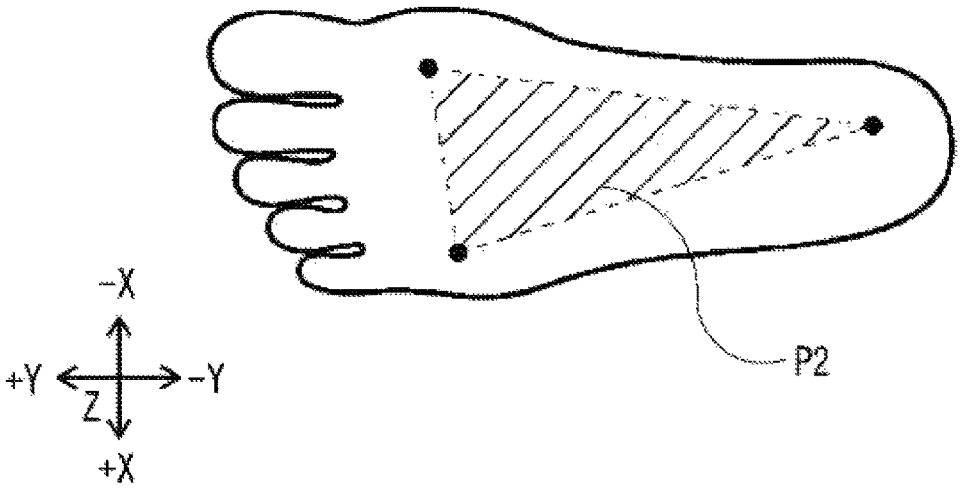
FIG. 13 shows a pressure distribution on the sole surface of the wearer when the footwear sheet is not placed on the bottom part of the footwear.

The footwear sheet 30 thus configured in accordance with the first embodiment has a function as follows. FIG. 11 shows a positional relationship between the sole surface of the wearer and the plantar aponeurosis pressure-applying portion 51. FIG. 12 shows a pressure distribution on the sole surface of the wearer when the footwear sheet 30 is placed on the bottom part 10 of the footwear 1. FIG. 13 shows a pressure distribution on the sole surface of the wearer when the footwear sheet 30 is not placed on the bottom part 10 of the footwear 1. Note that, in FIG. 12, a portion on which the pressure is relatively high is indicated by hatched lines as a pressure distribution P1 (loaded area). In FIG. 13, a portion on which the pressure is relatively high is indicated by hatched lines as a pressure distribution P2 (loaded area).

First, when the wearer wears the footwear 1, a portion of the plantar aponeurosis T10 of the wearer overlaps with the plantar aponeurosis pressure-applying portion 51 as shown in FIG. 11, so the portion of the plantar aponeurosis T10 becomes indirectly in contact with the plantar aponeurosis pressure-applying portion 51 with the base part 40 in between. Then, when the wearer stands up with this condition, the portion of the plantar aponeurosis T10 of the wearer is likely to be loaded. Accordingly, as indicated by the pressure distribution P1 in FIG. 12, the pressure on the portion of the plantar aponeurosis T10 of the wearer is higher than the pressure on the other portion.

On the other hand, when the wearer wears the footwear 1 on which the footwear sheet 30 is not placed, mainly, a portion of the sole surface of the wearer corresponding to a generally triangular area having vertices to which the calcaneal bone B37 of the tarsal B30, the phalanx B10-side end of the first metatarsal B20*a*, and the phalanx B10-side end of the fifth metatarsal B20*e* correspond, and a portion of the sole surface of the wearer corresponding to the distal phalanx B11 of the phalanx B10 become in contact with the bottom part 10 of the footwear 1. Then, when the wearer stands up with this condition, the portion corresponding to the generally triangular area near the center of gravity of the body is likely to be loaded. Accordingly, as indicated by the pressure distribution P2 in FIG. 13, the pressure on the portion corresponding to the generally triangular area is higher than the pressure on the other portion. In this case, a relatively high pressure is applied on a portion of the plantar aponeurosis T10, but this pressure is not sufficient to be able to correct the shape of the sole surface of the wearer.

Here, the comparison of the pressure distributions P1 and P2 results in the area of the pressure distribution P1 smaller than the area of the pressure distribution P2 (more specifically, the area of the pressure distribution P1 is less than half of the area of the pressure distribution P2). In view of this, it can be said that the pressure on the portion of the plantar aponeurosis T10 of the wearer when the footwear sheet 30 is placed on the bottom part 10 of the footwear 1 is significantly higher than the pressure on the plantar aponeurosis T10 of the wearer when the footwear sheet 30 is not placed on the bottom part 10 of the footwear 1. Accordingly, the significantly high pressure is applied on the portion of the plantar aponeurosis T10 of the wearer by the plantar aponeurosis pressure-applying portion 51, so the shape of the portion of the plantar aponeurosis T10 can be corrected so that it follows the shape of the plantar aponeurosis pressure-applying portion 51. This allows, when, for example, the wearer does training such as walking or running, a load to be put on the muscles of the foot located inside of the plantar aponeurosis and allows the muscles of the sole to be corrected so as to be used more strongly than usual, which can increase the amount of movement of the lower body muscles that are not used in the daily life connected to the muscles of the sole, so the strength of the lower body muscles can be further improved. Further, the pressure on the portion of the plantar aponeurosis T10 of the wearer higher than the pressure on the other portion rises the foot of the wearer higher and increases the length of stride in walking. Further, a portion other than the portion of the plantar aponeurosis T10 of the wearer can also be in contact with the base part 40, so a training can be done so that a balanced, ideal posture can be assumed.

(Advantageous Effects)

Thus, according to the first embodiment, the pressure-applying part 50 is provided on the opposite-side surface of the base part 40, and the pressure-applying part 50 is indirectly in contact with a portion of the sole surface of the wearer with the base part 40 in between, with the pressure on the portion of the sole surface of the wearer higher than the pressure on the other portion, which enables the shape of the sole surface of the wearer to be corrected so that it follows the shape of the pressure-applying part 50. So, a load can be put on a part of the wearer related to the portion of the sole surface of the wearer corrected by the pressure-applying part 50, allowing the user to be guided to an ideal posture appropriate for sport and the like, which enables the strength of the lower body muscles for the ideal posture to be improved, and can improve the efficiency in training for the user to be able to assume the ideal posture. Further, when the pressure-applying part 50 is provided on the opposite-side surface of the side surfaces of the base part 40 and the base part 40 is formed of relatively flexible material, a portion other than the portion of the sole surface of the wearer can also be in contact with the base part 40, so a training can be done so that a balanced, ideal posture can be assumed, which can ensure the stability.

Further, the pressure-applying part 50 includes the plantar aponeurosis pressure-applying portion 51 placed at the position corresponding to at least a portion of the plantar aponeurosis T10 of the wearer, so the plantar aponeurosis pressure-applying portion 51 can apply high pressure on the at least a portion of the plantar aponeurosis T10, which enables the shape of the sole surface of the wearer to be corrected so that it follows the shape of the plantar aponeurosis pressure-applying portion 51. This allows, when, for example, the wearer does training such as walking or running, a load to be put on the muscles of the foot located inside of the plantar aponeurosis and allows the muscles of the sole to be corrected so as to be used more strongly than usual, which can increase the amount of movement of the lower body muscles that are not used in the daily life connected to the muscles of the sole, so the strength of the lower body muscles can be further improved.

Second Embodiment

Next, a second embodiment is described. This embodiment includes the pressure-applying part having a joint pressure-applying portion. Note that a component that is generally the same as that of the first embodiment is denoted by the same numeral or name as used in the first embodiment and is not repeatedly described as appropriate.

(Configuration—Footwear Sheet)

Figure 14:
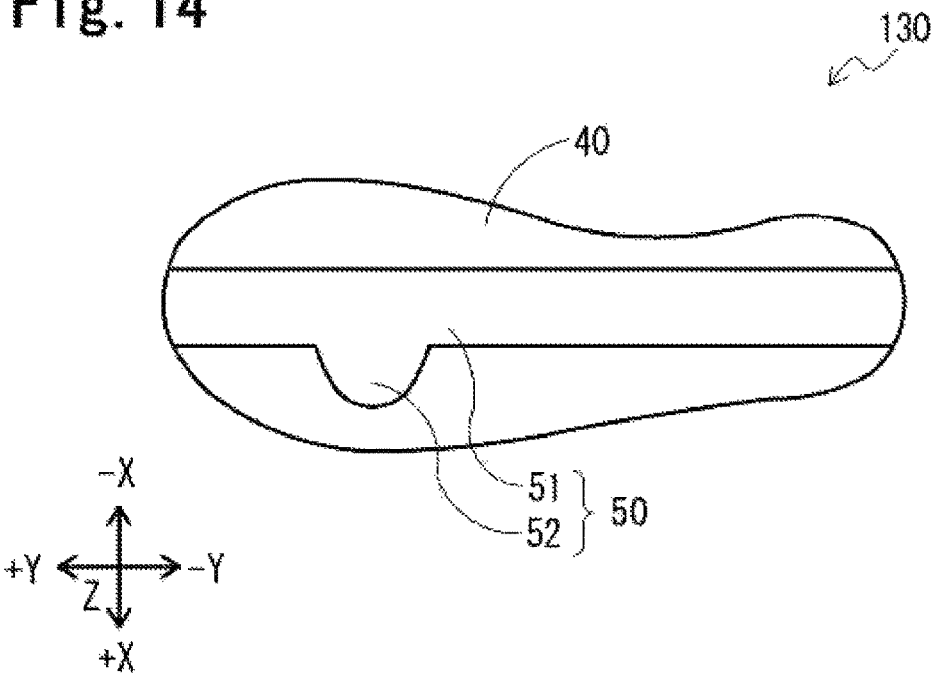
FIG. 14 is a bottom view showing a footwear sheet in accordance with a second embodiment.

First, the configuration of a footwear sheet 130 is described. FIG. 14 is a bottom view showing the footwear sheet 130 in accordance with the second embodiment. As shown in FIG. 14, the footwear sheet 130 in accordance with the second embodiment is configured in almost the same way as the footwear sheet 30 in accordance with the first embodiment except that the configuration of the pressure-applying part 50 is different.

(Configuration—Pressure-Applying Portion)

As shown in FIG. 14, the pressure-applying part 50 includes the plantar aponeurosis pressure-applying portion 51 and a joint pressure-applying portion 52.

(Configuration—Pressure-Applying Part—Joint Pressure-Applying Portion)

The joint pressure-applying portion 52 is intended to apply pressure on at least some joints of the foot of the wearer. As shown in FIG. 14, the joint pressure-applying portion 52 is formed in a generally plate-like body, and is provided on the opposite-side surface of the base part 40 at the position corresponding to the joint connecting the fifth proximal phalanx B13*e* and the fifth metatarsal B20*e* of the wearer.

Here, the detailed shape of the joint pressure-applying portion 52 is set as follows. Specifically, the planar shape of the joint pressure-applying portion 52 is set to be in a generally semicircular shape. More specifically, as shown in FIG. 10, the length in the X direction of the joint pressure-applying portion 52 is set to generally one fifth of the length in the X direction of the base part 40, and the length in the Y direction of the joint pressure-applying portion 52 is set to generally one fifth of the length in the Y direction of the base part 40. Further, the length in the Z direction of the joint pressure-applying portion 52 is set to be generally the same as that of the plantar aponeurosis pressure-applying portion 51 adjacent to the joint pressure-applying portion 52.

(Function of Footwear Sheet)

The footwear sheet 130 thus configured in accordance with the second embodiment has a function as follows. When the wearer wears the footwear 1, the joint connecting the fifth proximal phalanx B13*e* and the fifth metatarsal B20*e* of the wearer becomes indirectly in contact with the joint pressure-applying portion 52 with the base part 40 in between. When the wearer stands up with this condition, the pressure on the joint connecting the fifth proximal phalanx B13*e* and the fifth metatarsal B20*e* of the wearer is higher than the pressure on the other portion (however, excepting a portion of the plantar aponeurosis T10 of the wearer). Accordingly, the shape of the sole surface of the wearer can be corrected so that it follows the shape of the joint pressure-applying portion 52. This allows, when, for example, the wearer does training such as walking or running, the fifth proximal phalanx B13*e* and the fifth metatarsal B20*e* of the wearer to be held, which can prevent the force applied on the sole surface of the wearer from escaping toward the +X direction. Further, when the wearer swings a baseball bat, a force applied on a pivot foot is unlikely to escape from the fifth metatarsal B20*e* of the pivot foot toward the +X direction. Further, a force applied on a foot other than the pivot foot is also unlikely to escape from the fifth metatarsal B20*e* of the foot toward the +X direction.

Figure 15:
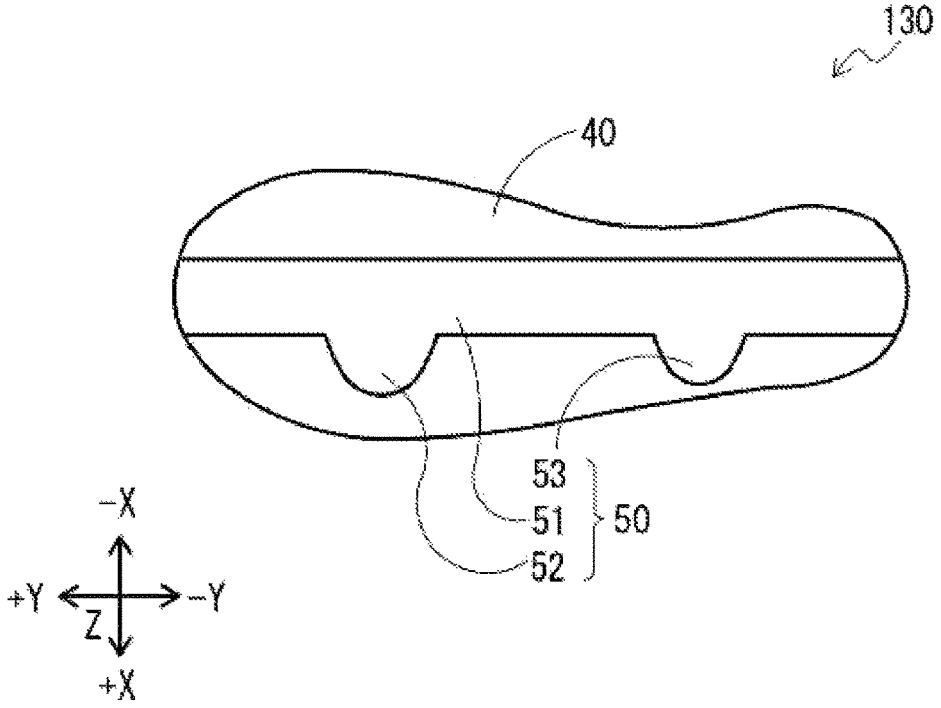
FIG. 15 is a bottom view showing a footwear sheet in accordance with a variation of the second embodiment.

Furthermore, the footwear sheet 130 may be configured in any appropriate structure. FIG. 15 is a bottom view showing a footwear sheet 130 in accordance with a variation of the second embodiment. As shown in FIG. 15, the footwear sheet 130 in accordance with the variation is configured in almost the same way as the footwear sheet 130 in accordance with the second embodiment except that a joint pressure-applying portion 53 is further added.

As shown in FIG. 15, the joint pressure-applying portion 53 is formed in a shape generally the same as that of the joint pressure-applying portion 52, and is placed on the opposite-side surface of the base part 40 at the position corresponding to a portion of a Chopart's joint of the wearer.

The footwear sheet 130 thus configured has a function as follows. When the wearer wears the footwear 1, the portion of the Chopart's joint of the wearer becomes indirectly in contact with the joint pressure-applying portion 53 with the base part 40 in between. When the wearer stands up with this condition, the pressure on the portion of the Chopart's joint of the wearer is higher than the pressure on the other portion (however, excepting a portion of the plantar aponeurosis T10 and the joint connecting the fifth proximal phalanx B13*e* and the fifth metatarsal B20*e* of the wearer). Accordingly, the shape of the sole surface of the wearer can be corrected so that it follows the shape of the joint pressure-applying portion 53. This allows, when, for example, the wearer does training such as walking or running, the surrounding area of the portion of the Chopart's joint of the wearer to be held, which can further prevent the force applied on the sole surface of the wearer from escaping toward the +X direction. Further, when the wearer swings a baseball bat, a force applied on a pivot foot is further unlikely to escape from the fifth metatarsal B20*e* of the pivot foot toward the +X direction. Further, a force applied on a foot other than the pivot foot is also further unlikely to escape from the fifth metatarsal B20*e* of the foot toward the +X direction.

(Advantageous Effects)

Thus, according to the second embodiment, the pressure-applying part 50 includes the joint pressure-applying portion 52 placed at the position corresponding to at least some joints of the foot of the wearer, so high pressure can be applied on the joints by the joint pressure-applying portion 52, which enables the shape of the sole surface of the wearer to be corrected so that it follows the shape of the joint pressure-applying portion 52.

Further, the joint pressure-applying portion 52 is placed at least at the position corresponding to the joint connecting the fifth proximal phalanx B13*e* and the fifth metatarsal B20*e* of the wearer, so high pressure can be applied on the joint connecting the fifth proximal phalanx B13*e* and the fifth metatarsal B20*e*. This allows, when, for example, the wearer does training such as walking or running, the fifth proximal phalanx B13*e* and the fifth metatarsal B20*e* of the wearer to be held, which can prevent the force applied on the sole surface of the wearer from escaping toward the +X direction. Further, when the wearer swings a baseball bat, a force applied on a pivot foot is unlikely to escape from the fifth metatarsal B20*e* of the pivot foot toward the +X direction, so the instability of the pivot foot can be reduced. Further, a force applied on a foot other than the pivot foot is also unlikely to escape from the fifth metatarsal B20*e* of the foot toward the +X direction, so the foot can be prevented from opening toward the +X direction.

Third Embodiment

Next, a third embodiment is described. This embodiment includes a thumb ball pressure-reducing portion. Note that a component that is generally the same as that of the first embodiment is denoted by the same numeral or name as used in the first embodiment and is not repeatedly described as appropriate.

(Configuration—Footwear Sheet)

Figure 16:
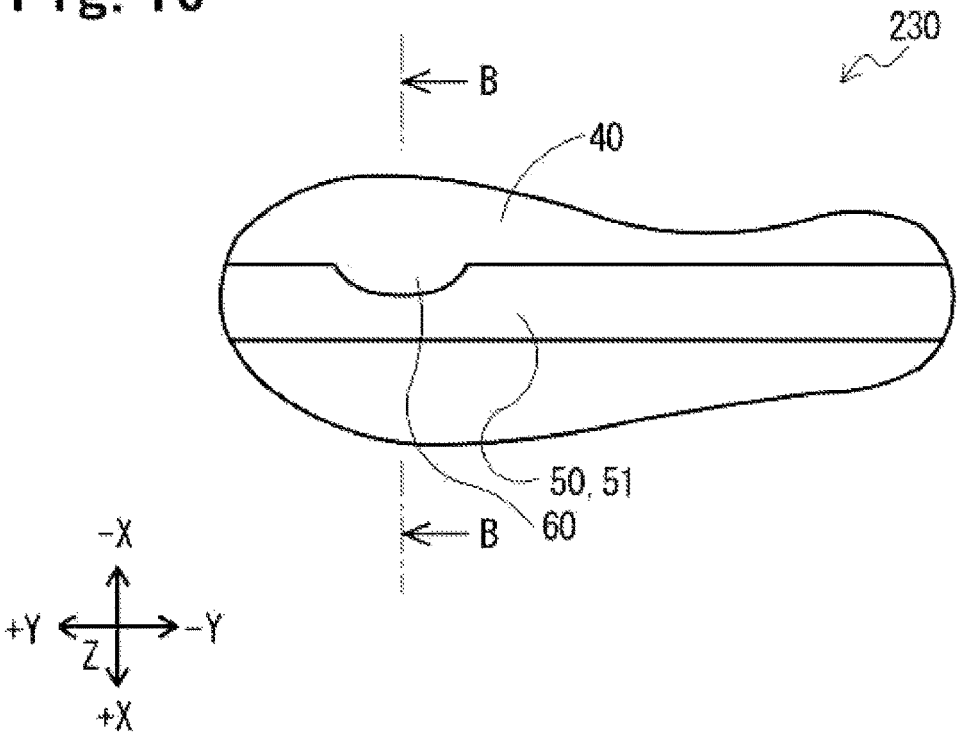
FIG. 16 is a bottom view showing a footwear sheet in accordance with a third embodiment.
Figure 17:
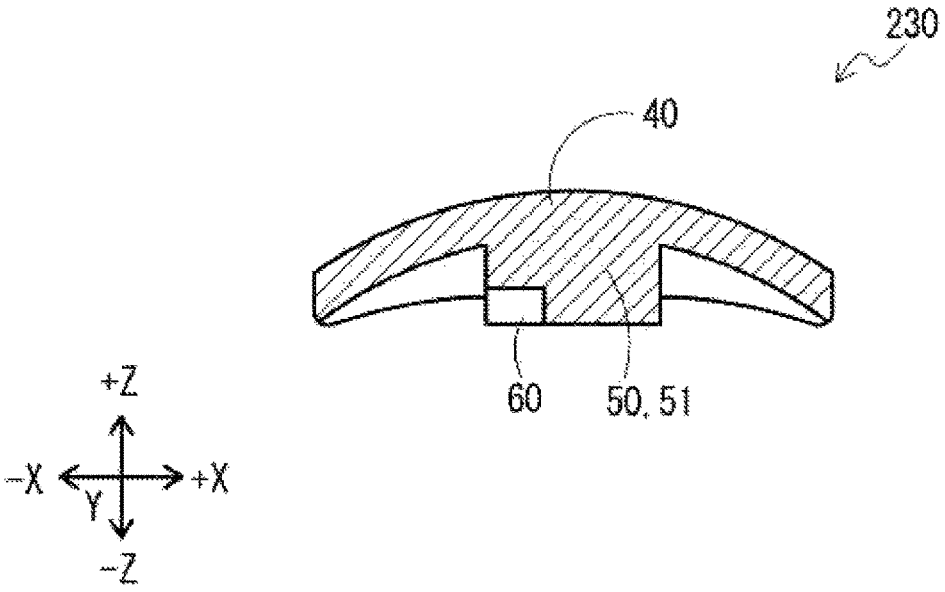
FIG. 17 is an upside-down B-B cross-sectional view of the footwear sheet shown in FIG. 16.

First, the configuration of a footwear sheet 230 is described. FIG. 16 is a bottom view showing the footwear sheet 230 in accordance with the third embodiment. FIG. 17 is an upside-down B-B cross-sectional view of the footwear sheet 230 shown in FIG. 16. As shown in FIGS. 16 and 17, the footwear sheet 230 in accordance with the third embodiment is configured in almost the same way as the footwear sheet 30 in accordance with the first embodiment except that a thumb ball pressure-reducing portion 60 is further added.

(Configuration—Thumb Ball Pressure-Reducing Portion)

The thumb ball pressure-reducing portion 60 is intended to reduce pressure on the thumb ball of the wearer. As shown in FIG. 16, the thumb ball pressure-reducing portion 60 is formed on a portion of the opposite-side surface of the base part 40 corresponding to the thumb ball of the wearer, as an open space in which the pressure-applying part 50 is not provided.

Here, the detailed shape of the thumb ball pressure-reducing portion 60 is set as follows. Specifically, the planar shape of the thumb ball pressure-reducing portion 60 is set to be in a generally semicircular shape. More specifically, as shown in FIG. 16, the length in the X direction of the thumb ball pressure-reducing portion 60 is set to generally one eighth of the length in the X direction of the base part 40, and the length in the Y direction of the thumb ball pressure-reducing portion 60 is set to generally one fifth of the length in the Y direction of the base part 40. Further, as shown in FIG. 17, the length in the Z direction of the thumb ball pressure-reducing portion 60 is set to be generally the same as the length in the Z direction of the plantar aponeurosis pressure-applying portion 51 adjacent to the thumb ball pressure-reducing portion 60.

With the shape of the thumb ball pressure-reducing portion 60 set in this way, the side surface of the plantar aponeurosis pressure-applying portion 51 adjacent to the thumb ball pressure-reducing portion 60 may also be formed in any appropriate shape, for example, as a vertical plane generally perpendicular to the base part 40 (this also applies to the shape of the side surface of the plantar aponeurosis pressure-applying portion 51 adjacent to a heel pressure-reducing portion 61 described later).

(Function of Footwear Sheet)

The footwear sheet 230 thus configured in accordance with the third embodiment has a function as follows. When the wearer wears the footwear 1, the thumb ball of the wearer becomes in contact with the base part 40 (or the thumb ball is not in contact with the base part 40). When the wearer stands up with this condition, the pressure on the thumb ball of the wearer is lower than the pressure on the plantar aponeurosis T10 of the wearer. That is, the thumb ball pressure-reducing portion 60 can reduce pressure on the thumb ball of the wearer, so the shape of the sole surface of the wearer can be corrected so that it follows the shape of the thumb ball pressure-reducing portion 60. This allows, when, for example, the wearer does training such as walking or running, a load put on a portion corresponding to from the big toe to the smallest toe of the sole surface of the wearer to be equalized. Further, when the wearer swings a baseball bat, the wearer becomes pigeon-toed, which facilitates putting muscle into the hip joint.

(Advantageous Effects)

Thus, according to the third embodiment, the thumb ball pressure-reducing portion 60 in which the pressure-applying part 50 is not provided is formed in the portion corresponding to the thumb ball of the wearer, so the pressure on the thumb ball can be reduced in comparison with the pressure on the portion of the wearer indirectly in contact with the pressure-applying part 50, which enables the shape of the sole surface of the wearer to be corrected so that it follows the shape of the thumb ball pressure-reducing portion 60. This allows, when, for example, the wearer does training such as walking or running, a load put on a portion corresponding to from the big toe to the smallest toe of the sole surface of the wearer to be equalized, allowing the muscle strength of the toes of the wearer to be improved. Further, when the wearer swings a baseball bat, the wearer becomes pigeon-toed, which facilitates putting muscle into the hip joint, so swing using only hands can be prevented.

Fourth Embodiment

Next, a fourth embodiment is described. This embodiment includes a heel pressure-reducing portion. Note that a component that is generally the same as that of the third embodiment is denoted by the same numeral or name as used in the third embodiment and is not repeatedly described as appropriate.

(Configuration—Footwear Sheet)

Figure 18:
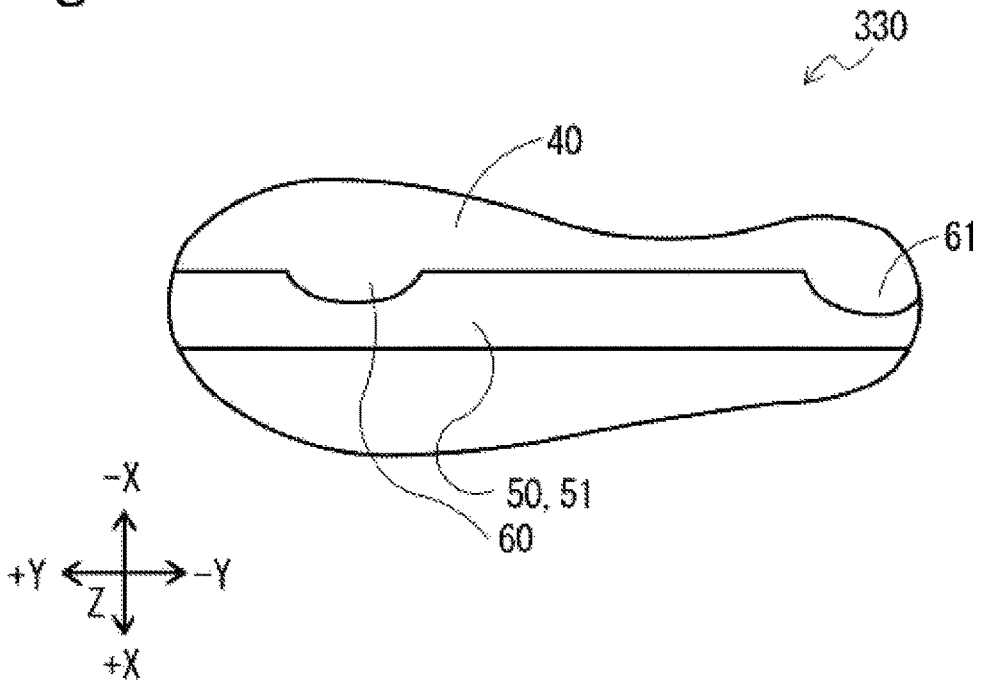
FIG. 18 is a bottom view showing a footwear sheet in accordance with a fourth embodiment.

First, the configuration of a footwear sheet 330 is described. FIG. 18 is a bottom view showing the footwear sheet 330 in accordance with the fourth embodiment. As shown in FIG. 18, the footwear sheet 330 in accordance with the fourth embodiment is configured in almost the same way as the footwear sheet 230 in accordance with the third embodiment except that a heel pressure-reducing portion 61 is further added.

(Configuration—Heel Pressure-Reducing Portion)

The heel pressure-reducing portion 61 is intended to reduce pressure on the "heel" of the wearer. Here, the "heel" is a portion of the sole surface corresponding to the calcaneal bone B37. As shown in FIG. 18, the heel pressure-reducing portion 61 is formed on a portion of the opposite-side surface of the base part 40 corresponding to the heel of the wearer, as an open space in which the pressure-applying part 50 is not provided.

Here, the detailed shape of the heel pressure-reducing portion 61 is set as follows. Specifically, the planar shape of the heel pressure-reducing portion 61 is set to be generally the same as the planar shape of the thumb ball pressure-reducing portion 60 (i.e., a generally semicircular shape). Further, the length in the Z direction of the heel pressure-reducing portion 61 is set to be generally the same as the length in the Z direction of the plantar aponeurosis pressure-applying portion 51 adjacent to the heel pressure-reducing portion 61.

(Function of Footwear Sheet)

The footwear sheet 330 thus configured in accordance with the fourth embodiment has a function as follows. When the wearer wears the footwear 1, the heel of the wearer becomes in contact with the base part 40 (or the heel is not in contact with the base part 40). When the wearer stands up with this condition, the pressure on the heel of the wearer is lower than the pressure on the plantar aponeurosis T10 of the wearer. So, the shape of the sole surface of the wearer can be corrected so that it follows the shape of the heel pressure-reducing portion 61. Accordingly, for example, when the wearer swings a baseball bat, the wearer becomes pigeon-toed, which facilitates putting muscle into the hip joint, as with the thumb ball pressure-reducing portion 60.

(Advantageous Effects)

Thus, according to the fourth embodiment, the heel pressure-reducing portion 61 in which the pressure-applying part 50 is not provided is formed in the portion corresponding to the heel of the wearer, so the pressure on the heel can be reduced in comparison with the pressure on the portion of the wearer indirectly in contact with the pressure-applying part 50, which enables the shape of the sole surface of the wearer to be corrected so that it follows the shape of the heel pressure-reducing portion 61. Accordingly, for example, when the wearer swings a baseball bat, the wearer becomes pigeon-toed, which facilitates putting muscle into the hip joint, so swing using only hands can be further prevented.

Fifth Embodiment

Next, a fifth embodiment is described. This embodiment includes the pressure-applying part having an arch-of-the-foot pressure-applying portion. Note that a component that is generally the same as that of the first embodiment is denoted by the same numeral or name as used in the first embodiment and is not repeatedly described as appropriate.

(Configuration—Footwear Sheet)

Figure 19:
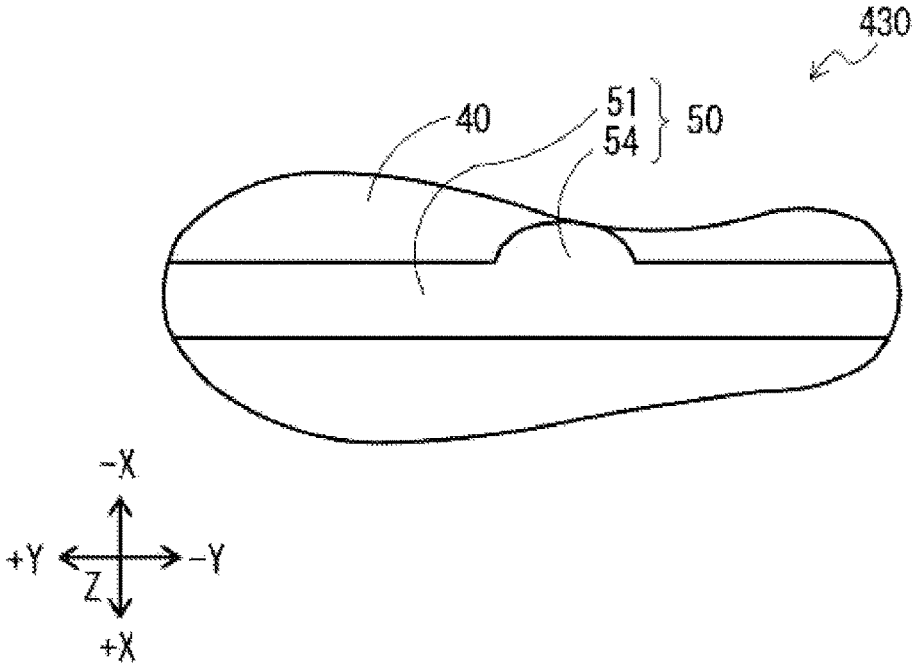
FIG. 19 is a bottom view showing a footwear sheet in accordance with a fifth embodiment.

First, the configuration of a footwear sheet 430 is described. FIG. 19 is a bottom view showing the footwear sheet 430 in accordance with the fifth embodiment. As shown in FIG. 19, the footwear sheet 430 in accordance with the fifth embodiment is configured in almost the same way as the footwear sheet 30 in accordance with the first embodiment except that the configuration of the pressure-applying part 50 is different.

(Configuration—Pressure-Applying Part)

As shown in FIG. 19, the pressure-applying part 50 includes the plantar aponeurosis pressure-applying portion 51 and an arch-of-the-foot pressure-applying portion 54.

(Configuration—Pressure-Applying Part—Arch-of-the-Foot Pressure-Applying Portion)

The arch-of-the-foot pressure-applying portion 54 is intended to apply pressure on at least some joints of the arch of the foot of the wearer. As shown in FIG. 19, the arch-of-the-foot pressure-applying portion 54 is formed in a generally plate-like body, and is provided on the opposite-side surface of the base part 40 at the position corresponding to the arch of the foot of the wearer.

Here, the detailed shape of the arch-of-the-foot pressure-applying portion 54 is set as follows. Specifically, the planar shape of the arch-of-the-foot pressure-applying portion 54 is set to be in a generally semicircular shape. More specifically, as shown in FIG. 19, the length in the X direction of the arch-of-the-foot pressure-applying portion 54 is set to generally one eighth of the length in the X direction of the base part 40, and the length in the Y direction of the arch-of-the-foot pressure-applying portion 54 is set to generally one fifth of the length in the Y direction of the base part 40. Further, the length in the Z direction of the arch-of-the-foot pressure-applying portion 54 is set to be generally the same as the length in the Z direction of the plantar aponeurosis pressure-applying portion 51 adjacent to the arch-of-the-foot pressure-applying portion 54.

(Function of Footwear Sheet)

The footwear sheet 430 thus configured in accordance with the fifth embodiment has a function as follows. When the wearer wears the footwear 1, the arch of the foot of the wearer becomes indirectly in contact with the arch-of-the-foot pressure-applying portion 54 with the base part 40 in between. When the wearer stands up with this condition, the pressure on the arch of the foot of the wearer is higher than the pressure on the other portion (however, excepting a portion of the plantar aponeurosis T10 of the wearer). Accordingly, the shape of the sole surface of the wearer can be corrected so that it follows the shape of the arch-of-the-foot pressure-applying portion 54. This allows, when, for example, the wearer does training such as walking or running, the arch of the foot of the wearer to be securely supported.

(Advantageous Effects)

Thus, according to the fifth embodiment, the pressure-applying part 50 includes the arch-of-the-foot pressure-applying portion 54 placed at the position corresponding to at least a portion of the arch of the foot of the wearer, so high pressure can be applied on the at least a portion of the arch of the foot by the arch-of-the-foot pressure-applying portion 54, which enables the shape of the sole surface of the wearer to be corrected so that it follows the shape of the arch-of-the-foot pressure-applying portion 54. This allows, when, for example, the wearer does training such as walking or running, the arch of the foot of the wearer to be securely supported, which can improve the stability of the foot and reduce fatigue of the foot.

Sixth Embodiment

Next, a sixth embodiment is described. This embodiment includes a rotational moving-facilitating portion. Note that a component that is generally the same as that of the first embodiment is denoted by the same numeral or name as used in the first embodiment and is not repeatedly described as appropriate.

(Configuration—Footwear Sheet)

Figure 20:
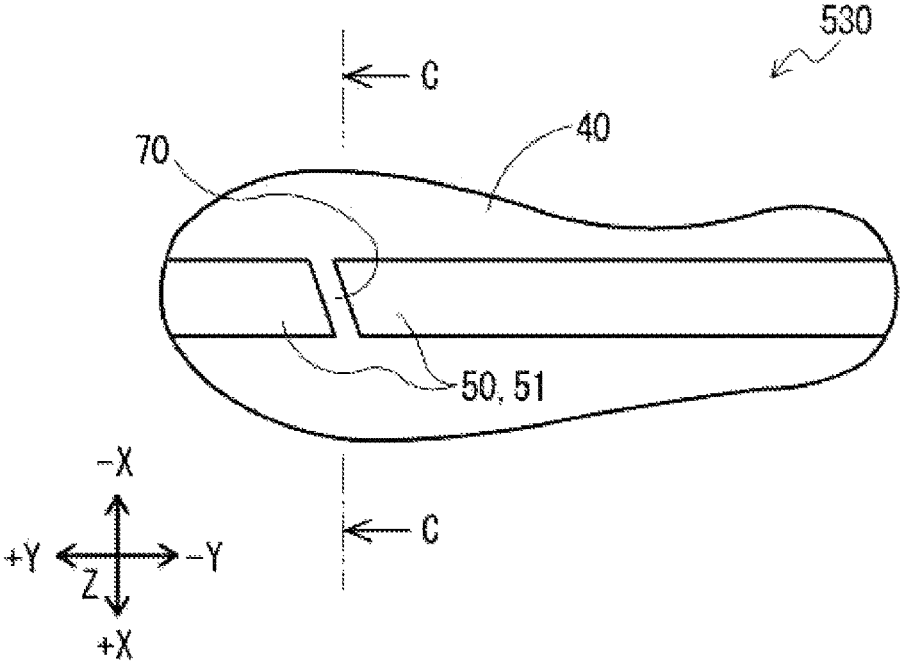
FIG. 20 is a bottom view showing a footwear sheet in accordance with a sixth embodiment.
Figure 21:
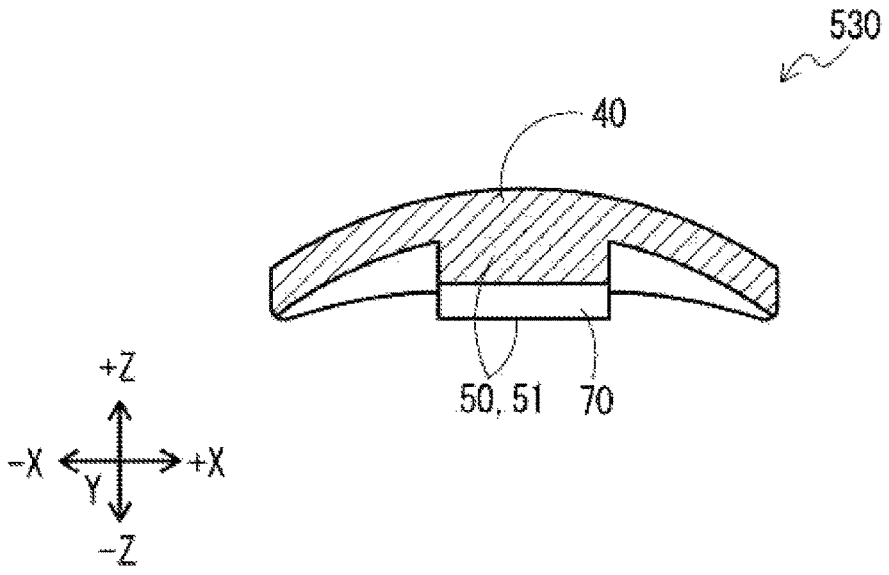
FIG. 21 is an upside-down C-C cross-sectional view of the footwear sheet shown in FIG. 20.

First, the configuration of a footwear sheet 530 is described. FIG. 20 is a bottom view showing the footwear sheet 530 in accordance with the sixth embodiment. FIG. 21 is an upside-down C-C cross-sectional view of the footwear sheet 530 shown in FIG. 20. As shown in FIGS. 20 and 21, the footwear sheet 530 in accordance with the sixth embodiment is configured in almost the same way as the footwear sheet 30 in accordance with the first embodiment except that the configuration of the plantar aponeurosis pressure-applying portion 51 is different.

(Configuration—Plantar Aponeurosis Pressure-Applying Portion—Rotational Moving-Facilitating Portion)

As shown in FIG. 20, the plantar aponeurosis pressure-applying portion 51 includes a groove portion 70. The groove portion 70 is a rotational moving-facilitating portion for facilitating rotational moving of a portion of the pressure-applying part 50 corresponding to the phalanx B10 of the wearer and a portion of the pressure-applying part 50 corresponding to the metatarsal B20 of the wearer relative to each other. The groove portion 70 is formed between a portion of the plantar aponeurosis pressure-applying portion 51 corresponding to the phalanx B10 of the wearer and a portion of the plantar aponeurosis pressure-applying portion 51 corresponding to the metatarsal B20 of the wearer.

Here, the detailed shape of the groove portion 70 is set as follows. Specifically, the planar shape of the groove portion 70 is set to be in a generally rectangular shape. More specifically, as shown in FIG. 20, the length in the X direction of the groove portion 70 is set to be generally the same as the length in the X direction of the plantar aponeurosis pressure-applying portion 51, and the length in the Y direction of the groove portion 70 is set to be comparable to the length between the portion corresponding to the phalanx B10 of the wearer and the portion corresponding to the metatarsal B20 of the wearer (e.g., 1 or 10 mm or so). Further, as shown in FIG. 21, the length in the Z direction of the groove portion 70 is set to be generally the same as the length in the Z direction of the plantar aponeurosis pressure-applying portion 51 adjacent to the groove portion 70.

(Function of Footwear Sheet)

The footwear sheet 530 thus configured in accordance with the sixth embodiment has a function as follows. When the wearer wears the footwear 1, the joint connecting the phalanx B10 of the wearer and the metatarsal B20 of the wearer becomes in contact with the base part 40 (or from the phalanx B10 to the metatarsal B20 is not in contact with the base part 40). When the wearer raises the heel with this condition, the toes are bent centering around the joint connecting the phalanx B10 of the wearer and the metatarsal B20 of the wearer with the portion corresponding the phalanx B10 of the wearer maintained to be parallel to the ground or the like, which facilitates raising only the metatarsal B20 and the upper portion therefrom. So, when, for example, the wearer does training such as walking or running, this facilitates putting muscle against the ground or the like through the portion corresponding to the phalanx B10 of the wearer, thereby effectively holding the ground.

Figure 22:
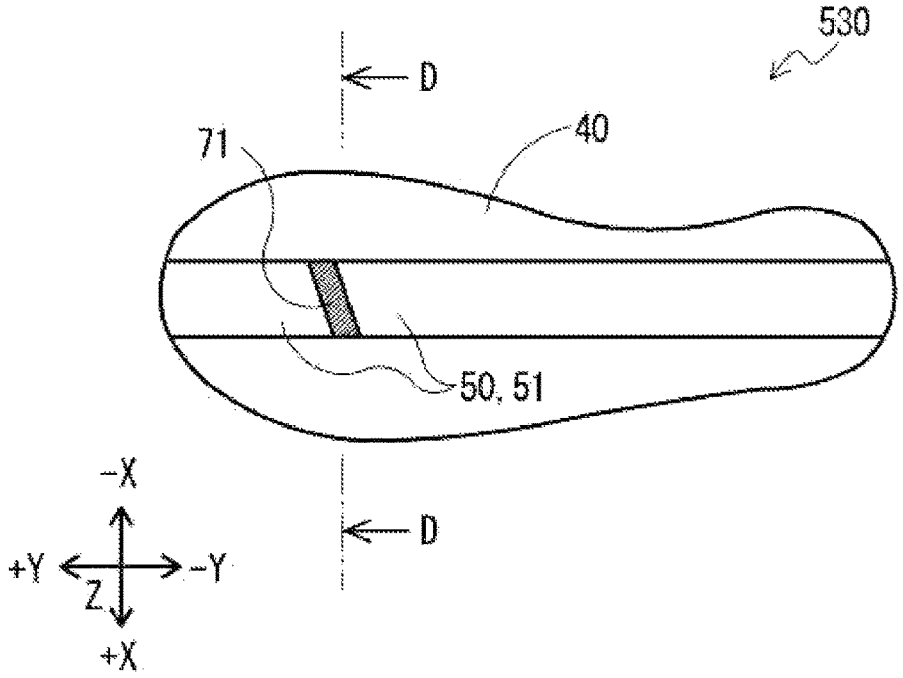
FIG. 22 is a bottom view showing a footwear sheet in accordance with a variation of the sixth embodiment.
Figure 23:
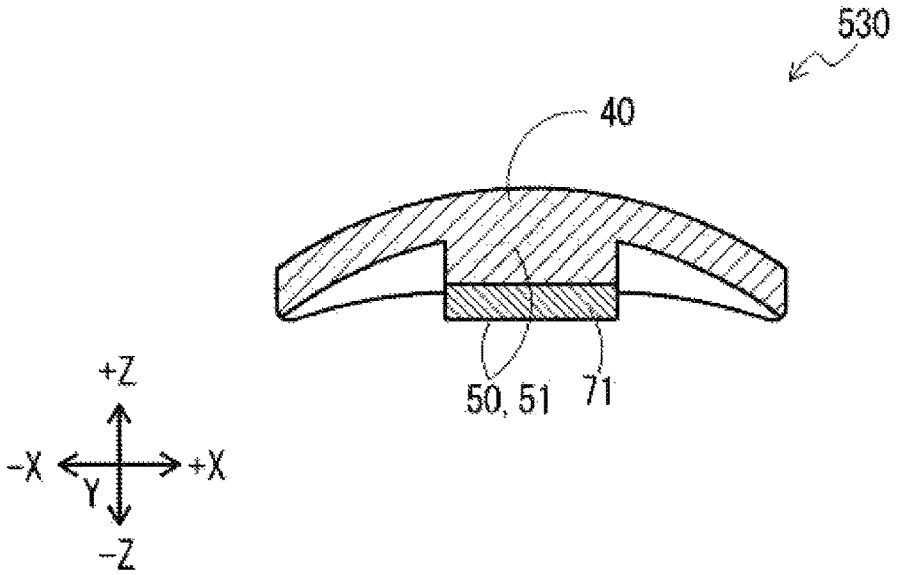
FIG. 23 is an upside-down D-D cross-sectional view of the footwear sheet shown in FIG. 22.

The footwear sheet 530 may be configured in any appropriate structure other than described above. FIG. 22 is a bottom view showing the footwear sheet 530 in accordance with a variation of the sixth embodiment. FIG. 23 is an upside-down D-D cross-sectional view of the footwear sheet 530 shown in FIG. 22. As shown in FIGS. 22 and 23, the footwear sheet 530 in accordance with the variation is configured in almost the same way as the footwear sheet 530 in accordance with the sixth embodiment except that a belt-like portion 71 is configured in place of the groove portion 70.

As shown in FIG. 22, the belt-like portion 71 is a rotational moving-facilitating portion for facilitating rotational moving of the portion of the pressure-applying part 50 corresponding to the phalanx B10 of the wearer and the portion of the pressure-applying part 50 corresponding to the metatarsal B20 of the wearer relative to each other. The belt-like portion 71 is a generally square-like body formed in a shape generally the same as that of the groove portion 70, and is placed between the portion of the plantar aponeurosis pressure-applying portion 51 corresponding to the phalanx B10 of the wearer and the portion of the plantar aponeurosis pressure-applying portion 51 corresponding to the metatarsal B20 of the wearer.

Here, the belt-like portion 71 is formed of a material that is, for example, more flexible than the portion of the plantar aponeurosis pressure-applying portion 51 corresponding to the phalanx B10 of the wearer and the portion of the plantar aponeurosis pressure-applying portion 51 corresponding to the metatarsal B20 of the wearer (specifically, flexible polyurethane, flexible rubber, etc.) so that the joint connecting the phalanx B10 of the wearer and the metatarsal B20 of the wearer can be caused to sink down.

The footwear sheet 530 thus configured has a function as follows. When the wearer wears the footwear 1, the joint connecting the phalanx B10 of the wearer and the metatarsal B20 of the wearer becomes in contact with the belt-like portion 71. When the wearer raises the heel with this condition, the toes become able to be bent centering around the joint connecting the phalanx B10 of the wearer and the metatarsal B20 of the wearer, which facilitates effectively holding the ground when, for example, the wearer does training such as walking or running, as with the groove portion 70 described above. Further, when the wearer is standing, the belt-like portion 71 allows the joint connecting the phalanx B10 of the wearer and the metatarsal B20 of the wearer to be supported to reduce the load on the foot.

(Advantageous Effects)

Thus, according to the sixth embodiment, the rotational moving-facilitating portion for facilitating rotational moving of the portion of the pressure-applying part 50 corresponding to the phalanx B10 of the wearer and the portion of the pressure-applying part 50 corresponding to the metatarsal B20 of the wearer relative to each other is provided between these two portions, so, when the wearer raises the heel, the toes become able to be bent centering around the joint connecting the phalanx B10 of the wearer and the metatarsal B20 of the wearer. This facilitates effectively holding the ground, allowing the load on the foot to be reduced when, for example, the wearer does training such as walking or running.

Further, the rotational moving-facilitating portion is formed to be the groove portion 70, so any special component is not required for forming the rotational moving-facilitating portion, allowing the manufacturing cost of the footwear sheet 530 to be reduced.

Variation of Embodiments

The embodiments in accordance with the invention have been described above. However, the specific configuration and means of the invention can be varied and modified in any appropriate way within the scope of the technical idea of the inventions described in the Claims. Such a variation is described below.

Note on Technical Problem and Advantageous Effects of Invention

Note that the problems to be solved by the invention and the advantage of the invention is not limited to the above description. The invention may solve a problem that is not described above or may achieve an advantage that is not described above. Also, the invention may solve only part of the problem described above or may achieve only part of the advantage described above. For example, even when the pressure-applying part 50 has difficulty in correcting the shape of the sole surface of the wearer so that it follows the shape of the pressure-applying part 50, if this correction by the pressure-applying part 50 has been achieved as before using a technique different than before, the problem of the invention has been solved.

Combination of the Embodiments

For the configurations shown in the first to sixth embodiments, a plurality of the configurations of the same embodiment may be combined or the configurations of the different embodiments may be combined with each other.

Figure 24:
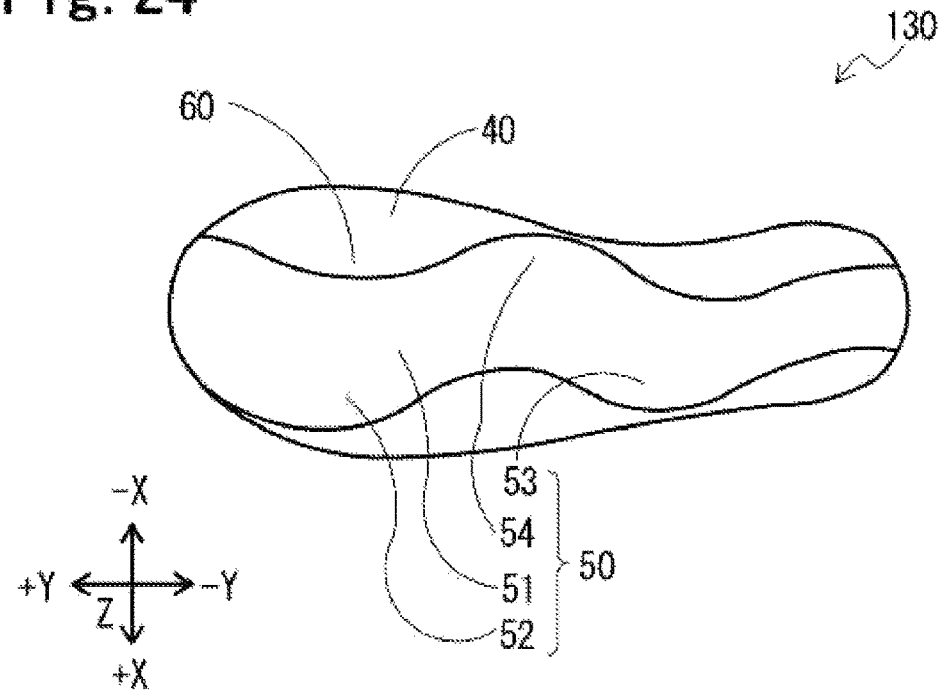
FIG. 24 is a bottom view showing a footwear sheet in accordance with a variation of the second embodiment.

For example, as shown in FIG. 24, the footwear sheet 130 in accordance with the variation of the second embodiment may include the thumb ball pressure-reducing portion 60 of the footwear sheet 230 in accordance with the third embodiment and the arch-of-the-foot pressure-applying portion 54 of the footwear sheet 430 in accordance with the fifth embodiment combined therewith. In this case, the plantar aponeurosis pressure-applying portion 51 is formed in a curved shape with the joint pressure-applying portions 52, 53, the thumb ball pressure-reducing portion 60 and the arch-of-the-foot pressure-applying portion 54 as a node. This allows smooth shift in the center of gravity in walking when, for example, the wearer does training such as walking or running.

Figure 25:
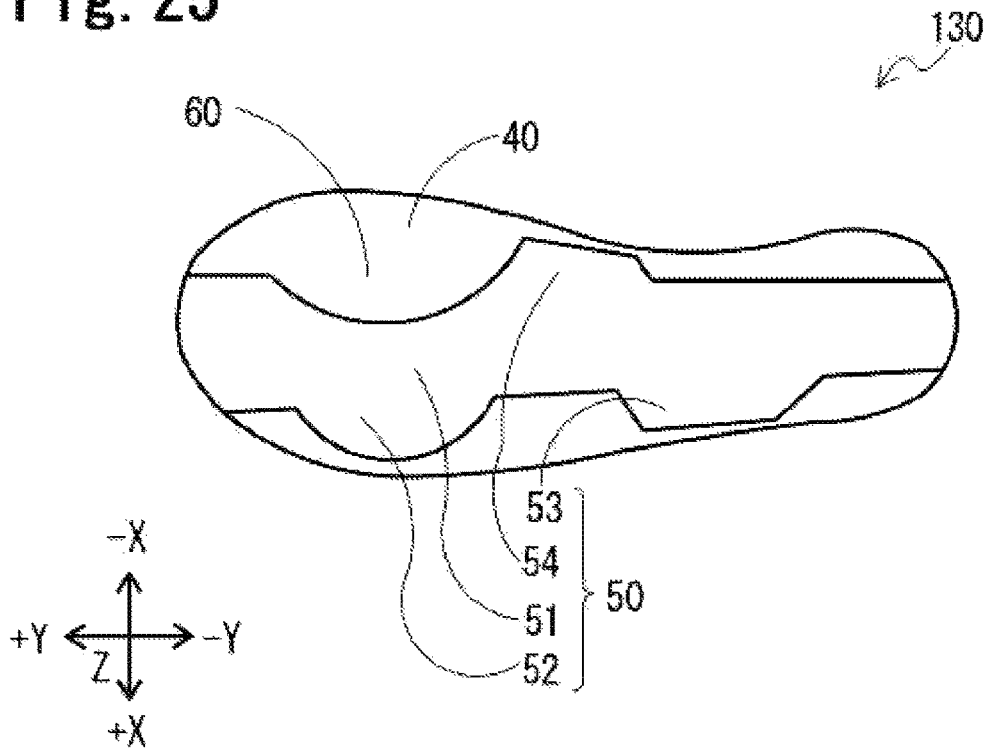
FIG. 25 is a bottom view showing a footwear sheet in accordance with a variation of the second embodiment.

Further, as shown in FIG. 25, the footwear sheet 130 in accordance with the variation of the second embodiment may also include the thumb ball pressure-reducing portion 60 of the footwear sheet 230 in accordance with the third embodiment and the arch-of-the-foot pressure-applying portion 54 of the footwear sheet 430 in accordance with the fifth embodiment combined therewith in a shape different from that of FIG. 24. In this case, the planar shape of the joint pressure-applying portion 52 and the thumb ball pressure-reducing portion 60 shown in FIG. 25 is largely curved in comparison with the planar shape of the joint pressure-applying portion 52 and the thumb ball pressure-reducing portion 60 shown in FIG. 24. So, in comparison with the footwear sheet 130, the pressure on the portion corresponding to from the first proximal phalanx B13*a* to the fifth proximal phalanx B13*e* and the portion corresponding to from the first metatarsal B20*a* to the fifth metatarsal B20*e* of the sole surface of the wearer shown in FIG. 25 can be increased. Further, the planar shape of the plantar aponeurosis pressure-applying portion 51, the joint pressure-applying portions 52, 53, the thumb ball pressure-reducing portion 60 and the arch-of-the-foot pressure-applying portion 54 shown in FIG. 25 is set to be larger than the planar shape of the plantar aponeurosis pressure-applying portion 51, the joint pressure-applying portions 52, 53, the thumb ball pressure-reducing portion 60 and the arch-of-the-foot pressure-applying portion 54 shown in FIG. 24, so the stability can be improved in comparison with the footwear sheet 130 shown in FIG. 25.

Figure 26:
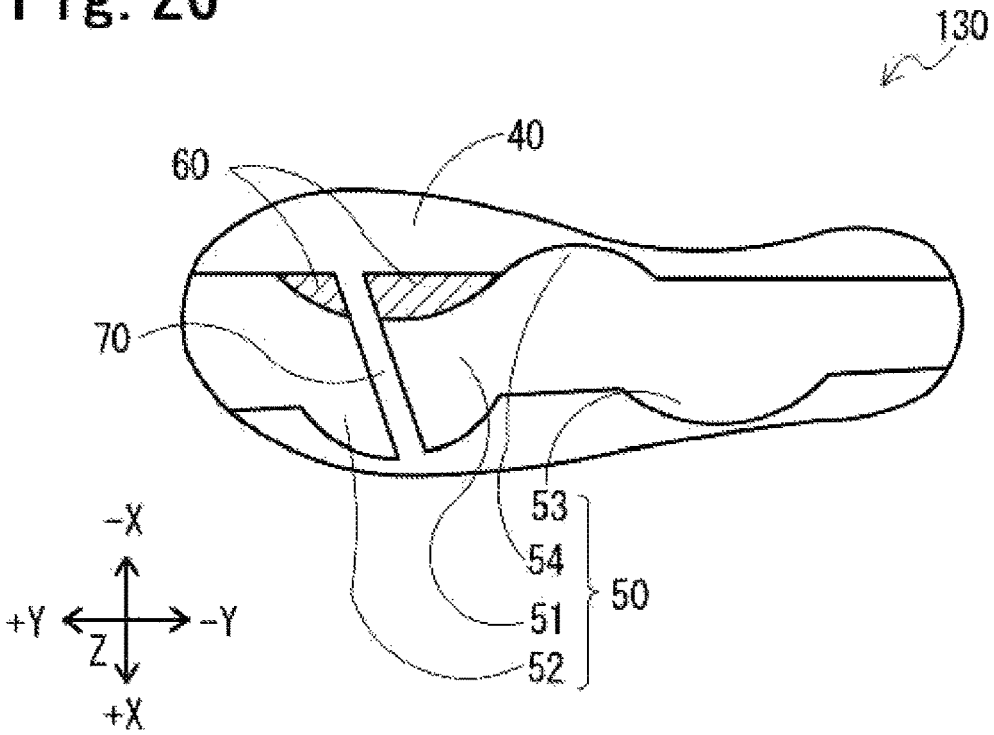
FIG. 26 is a bottom view showing a footwear sheet in accordance with a variation of the second embodiment.

Further, as shown in FIG. 26, the footwear sheet 130 in accordance with the variation of the second embodiment may include the thumb ball pressure-reducing portion 60 of the footwear sheet 230 in accordance with the third embodiment, the arch-of-the-foot pressure-applying portion 54 of the footwear sheet 430 in accordance with the fifth embodiment and the groove portion 70 of the footwear sheet 530 in accordance with the sixth embodiment combined therewith. In this case, the side surface of the plantar aponeurosis pressure-applying portion 51 adjacent to the thumb ball pressure-reducing portion 60 may also be formed as a ramped surface that approach the middle portion of the plantar aponeurosis pressure-applying portion 51 gradually from the +Z direction to the −Z direction. This allows reducing the pressure on the thumb ball of the wearer while supporting the thumb ball.

Figure 27:
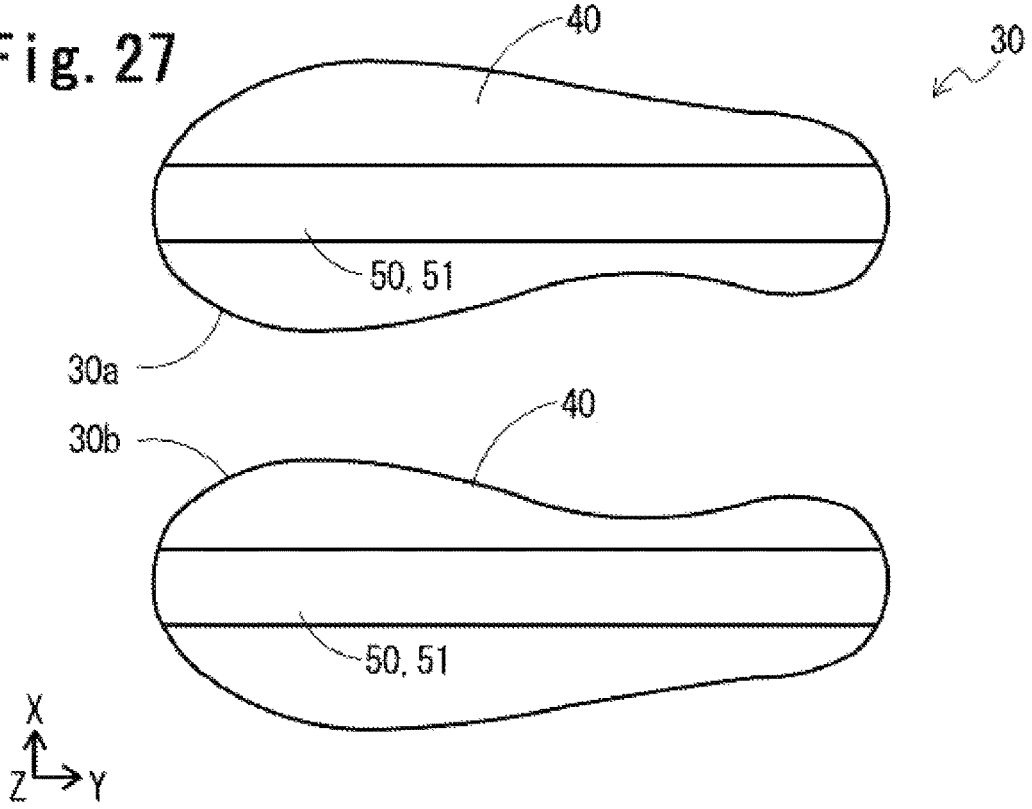
FIG. 27 is a bottom view showing a footwear sheet in accordance with a variation of the first embodiment.
Figure 28:
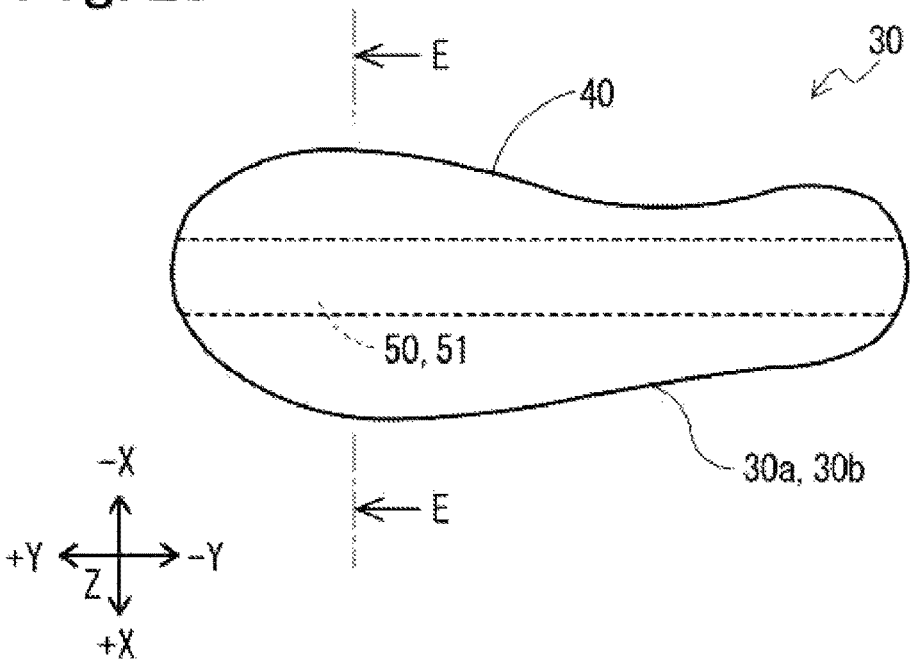
FIG. 28 is a plan view showing a state in which the footwear sheets shown in FIG. 27 are stacked on each other.
Figure 29:
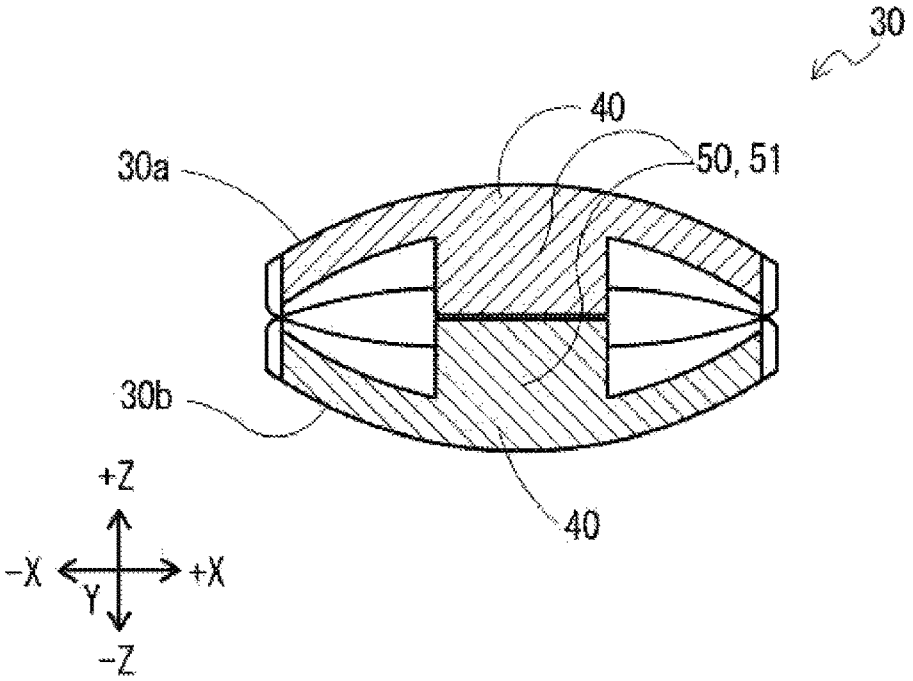
FIG. 29 is an E-E cross-sectional view of the footwear sheet shown in FIG. 28.

Further, a pair of the footwear sheets in accordance with the first to sixth embodiments may be combined with each other. Specifically, as shown in FIGS. 27 to 29, the footwear sheet 30 in accordance with the first embodiment includes footwear sheets 30*a*, 30*b*, and the footwear sheets 30*a*, 30*b* are stacked on each other such that the respective pressure-applying parts 50 (plantar aponeurosis pressure-applying portion 51 in FIG. 27) of the footwear sheets 30*a*, 30*b* face each other, and the respective base parts 40 of the footwear sheets 30*a*, 30*b* are symmetrical with these facing pressure-applying parts 50 as a symmetrical center. This configuration allows further increasing the pressure on a portion of the sole surface of the wearer in contact with the pressure-applying part 50, which further facilitates correcting the shape of the sole surface of the wearer so that it follows the shape of the pressure-applying part 50. Further, the footwear sheet 30*a* may be used on the sole surface side, and when it is reversed, the footwear sheet 30*b* may be used on the sole surface side, so the footwear sheet 30 may be used for any of the right and left foot of the wearer, which allows differentiation of use between the right and left foot depending on the use intended by the wearer.

(On What is Provided with the Footwear Sheet)

Figure 30:
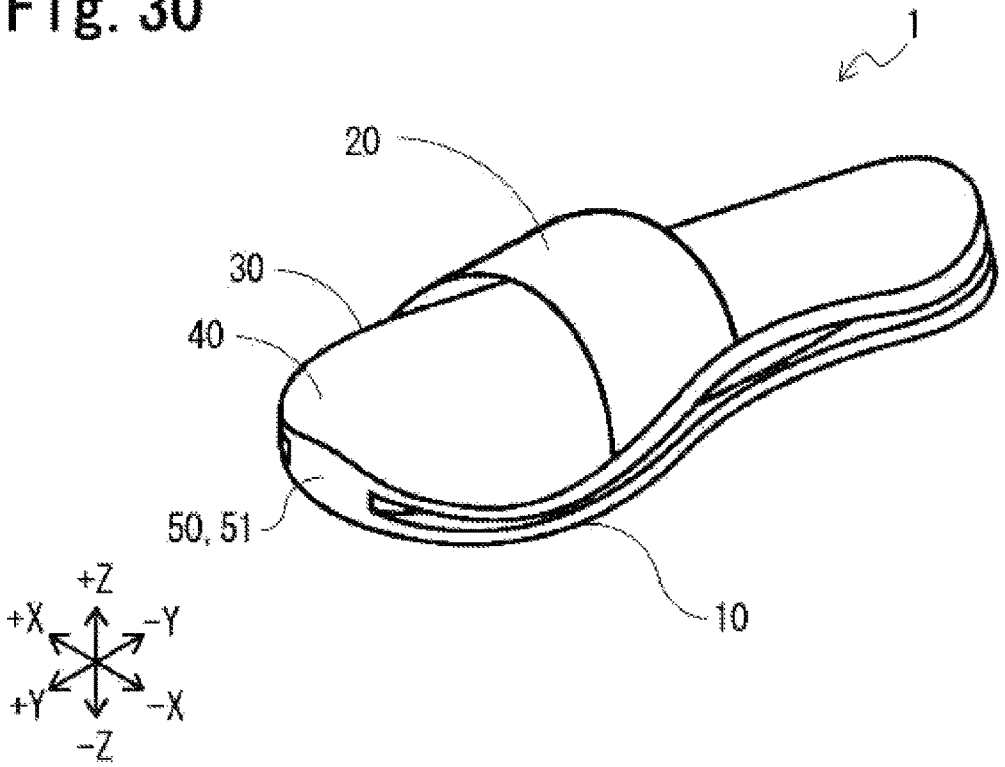
FIG. 30 is a perspective view showing an overview of a footwear in accordance with a variation of the first embodiment.

In the first to sixth embodiments, the case of applying the footwear sheet to shoes has been described. However, the footwear sheet is not limited to this, and for example, may also be applied to sandals. Specifically, as shown in FIG. 30, the footwear sheet 30 in accordance with the first embodiment may also be fixed to a bottom part 10 of the sandal with an adhesive or the like. Alternatively, the footwear sheet 30 may be used as a bottom part (outsole) itself of various types of footwears including the sandals. For example, in order to use the footwear sheet 30 as the bottom part of the sandal, a strap may be fixed to the base part 40 of the footwear sheet 30 so that the foot can be inserted between the strap and the base part 40 to wear the sandal. Further, in the embodiments described above, the operational advantage in the case of swinging a baseball bat has been illustrated. However, the user wearing the footwear sheet may perform any type and content of action. For example, the same operational advantage may also be achieved in swinging a tennis racket or golf club.

(On Base Part)

In the first to sixth embodiments, the planar shape of the base part 40 has been described as being set to be generally the same as that of the bottom part 10. However, for example, it may also be set to be smaller or larger than that of the bottom part 10. Further, the side-surface shape of the base part 40 has been described as being set to be in a shape in which the base part 40 is convexly curved toward the +Z direction. However, for example, it may also be set to be flat. Further, the length in the Z direction of the base part 40 has been described such that the length in the Z direction of the portion of the base part 40 corresponding to the proximal phalanx B13 and the metatarsal B20 of the wearer is set to be longer than that of the other portion. However, for example, all of the portions may also be set to have the same length in the Z direction. Further, the base part 40 may also be set to have an uneven wall thickness. For example, it may be set to have the wall thickness that is largest at the middle portion in the outward-inward direction and the outward-inward direction and gradually decreases toward the end in the outward-inward direction and the outward-inward direction.

(On Pressure-Applying Part)

In the first to sixth embodiments, the pressure-applying part 50 has been described as being provided on the opposite-side surface of the base part 40. However, the base part 40 is not limited to this, and for example, may be provided on the sole-side surface of the base part 40.

Figure 31:
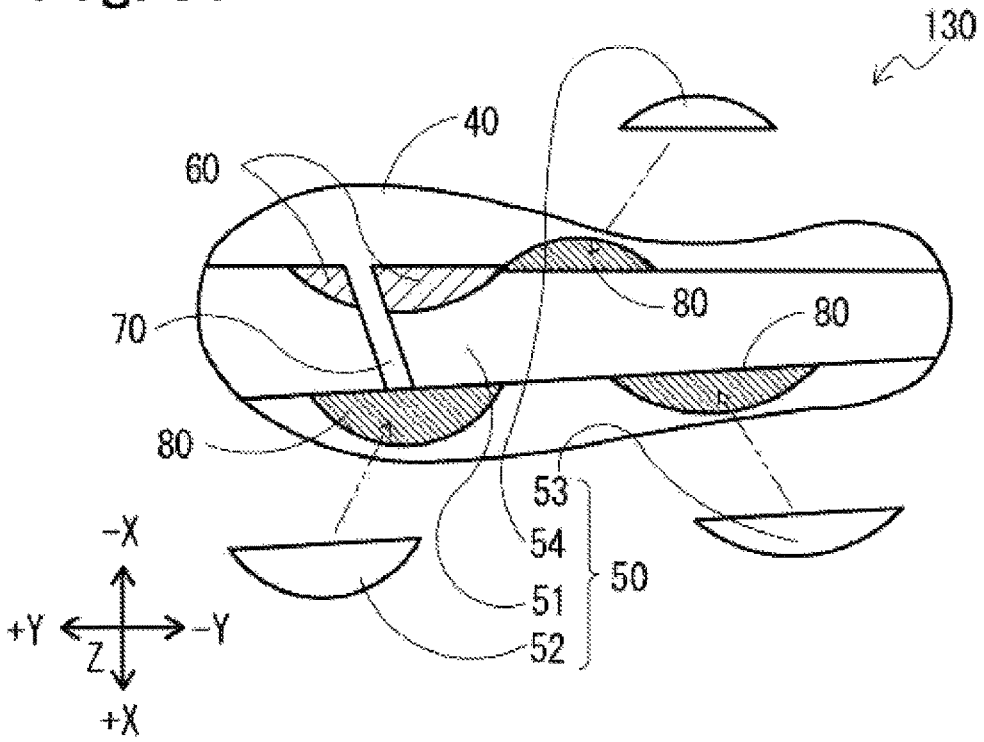
FIG. 31 is a bottom view showing a footwear sheet in accordance with a variation of the second embodiment.

Further, in the first to sixth embodiments, the pressure-applying part 50 has been described as being formed by integrally molding the base part 40 and the pressure-applying part 50. However, the base part 40 is not limited to this, and for example, may also be formed separate from the base part 40. In this case, the pressure-applying part 50 may also be removable from the base part 40. Specifically, as shown in FIG. 31, an attaching/removing mechanism 80 (for example, fixing structure using a well-known hook and loop fastener, screwing structure, locking structure, fixing by small-screw structure, bonding, etc.) may be provided on the opposite-side surface of the base part 40 so that the joint pressure-applying portions 52, 53 or the arch-of-the-foot pressure-applying portion 54 can be removably attached. This configuration allows the joint pressure-applying portions 52, 53 or the arch-of-the-foot pressure-applying portion 54 to be attached or removed depending on the use intended by the wearer.

Further, the pressure-applying part 50 may be provided with an elastic member in the pressure-applying part 50, on a side surface facing the base part 40 or on a side surface opposite the base part 40. The elastic member may be a member that, when a pressure is applied thereon, generates an elastic force (repulsive force) generally corresponding to the amount of applied pressure, such as plate spring, coil spring, high rebound resin material, etc. Such an elastic material is placed so as to generate an elastic force (repulsive force) almost parallel to the upward-downward direction. For example, this increases the elastic force in the upward-downward direction of the pressure-applying part 50, which can increase the pressure applied to the sole by the pressure-applying part 50, providing an effect of facilitating raising the user's foot to increase the length of stride, improving the jumping ability of the user or increasing the power of walking of the user. Thus, when the elastic member may be provided to the pressure-applying part 50, the specific placement may be done in any appropriate way. For example, when the elastic member may be provided to the plantar aponeurosis pressure-applying portion 51, the elastic member may be provided continuously or discontinuously over the range from near the front end (portion corresponding to the toes) or rotational moving-facilitating portion of the plantar aponeurosis pressure-applying portion 51 to near the rear end (portion corresponding to the heel) of the plantar aponeurosis pressure-applying portion 51.

(On Plantar Aponeurosis Pressure-Applying Portion)

In the first to sixth embodiments, the planar shape of the plantar aponeurosis pressure-applying portion 51 has been described as being set to be a shape that can be in contact with a portion of the plantar aponeurosis T10 of the wearer. However, for example, it may also be set to be a shape that can be in contact with the whole of the plantar aponeurosis T10 of the wearer. Further, the length in the Z direction of the plantar aponeurosis pressure-applying portion 51 has been described such that the length in the Z direction of the portion of the plantar aponeurosis pressure-applying portion 51 corresponding to the neighborhood of the "arch of the foot" of the wearer is set to be longer than that of the other portion. However, for example, all of the portions may also be set to have the same length in the Z direction.

Further, in the second and fifth embodiments, the footwear sheet has been described as including the plantar aponeurosis pressure-applying portion 51. However, the plantar aponeurosis pressure-applying portion 51 may be omitted.

(On Joint Pressure-Applying Portion)

In the second embodiment, the planar shape of the joint pressure-applying portion 52 has been described as being set to be in a generally semicircular shape. However, for example, it may also be set to be in a square shape, such as rectangular or triangular shape (this also applies to the planar shape of the joint pressure-applying portion 53). Further, the length in the Z direction of the joint pressure-applying portion 52 has been described as being set to be generally the same as that of the plantar aponeurosis pressure-applying portion 51 adjacent to the joint pressure-applying portion 52. However, for example, it may also be set to be longer or shorter than the length in the Z direction of the adjacent plantar aponeurosis pressure-applying portion 51 (this also applies to the length in the Z direction of the joint pressure-applying portion 53). Further, the number of the joint pressure-applying portion 52 to be placed has been described as one. However, it may also be two or more (this also applies to the number of the joint pressure-applying portion 53). In this case, the planar shape of the joint pressure-applying portion 52 is set to be in a shape in which the joint connecting the fifth proximal phalanx B13*e* and the fifth metatarsal B20*e* of the wearer can be covered by the two or more joint pressure-applying portion 52.

(On Thumb Ball Pressure-Reducing Portion and Heel Pressure-Reducing Portion)

In the second and third embodiments, the planar shape of the thumb ball pressure-reducing portion 60 has been described as being set to be in a generally semicircular shape. However, for example, it may also be set to be in a square shape, such as rectangular or triangular shape (this also applies to the planar shape of the heel pressure-reducing portion 61). Further, the length in the Z direction of the thumb ball pressure-reducing portion 60 has been described as being set to be generally the same as that of the plantar aponeurosis pressure-applying portion 51 adjacent to the thumb ball pressure-reducing portion 60. However, for example, it may also be set to be shorter than the length in the Z direction of the adjacent plantar aponeurosis pressure-applying portion 51 (this also applies to the length in the Z direction of the heel pressure-reducing portion 61). Further, the side surface of the plantar aponeurosis pressure-applying portion 51 adjacent to the thumb ball pressure-reducing portion 60 has been described as being formed as a vertical plane. However, as shown in FIG. 26, it may also be formed as a ramped surface (this also applies to the shape of the side surface of the plantar aponeurosis pressure-applying portion 51 adjacent to the heel pressure-reducing portion 61).

Further, in the third and fourth embodiments, the thumb ball pressure-reducing portion 60 or the heel pressure-reducing portion 61 has been described as being formed as an open space. However, they are not limited to this, and for example, may also be formed of a more flexible material than the pressure-applying part 50 (specifically, flexible polyurethane, flexible rubber, etc.).

(On Arch-of-the-Foot Pressure-Applying Portion)

In the fifth embodiment, the planar shape of the arch-of-the-foot pressure-applying portion 54 has been described as being set to be a shape that can be in contact with the whole of the arch of the foot of the wearer. However, for example, it may be set to be a shape that can be in contact with a portion of the arch of the foot of the wearer. Further, the planar shape of the arch-of-the-foot pressure-applying portion 54 has been described as being set to be in a generally semicircular shape. However, for example, it may also be set to be in a square shape, such as rectangular or triangular shape. Further, the length in the Z direction of the arch-of-the-foot pressure-applying portion 54 has been described as being set to be generally the same as that of the plantar aponeurosis pressure-applying portion 51 adjacent to the arch-of-the-foot pressure-applying portion 54. However, for example, it may also be set to be longer than the length in the Z direction of the adjacent plantar aponeurosis pressure-applying portion 51. Further, the number of the arch-of-the-foot pressure-applying portion 54 to be placed has been described as one. However, it may also be two or more.

(On Groove Portion, Belt-Like Portion)

In the sixth embodiment, the planar shape of the groove portion 70 has been described as being set to be in a generally rectangular shape. However, for example, it may also be set to be curved (this also applies to the planar shape of the belt-like portion 71). Further, the length in the Z direction of the groove portion 70 has been described as being set to be generally the same as that of the plantar aponeurosis pressure-applying portion 51 adjacent to the groove portion 70. However, for example, it may also be set to be shorter than the length in the Z direction of the adjacent plantar aponeurosis pressure-applying portion 51 (this also applies to the length in the Z direction of the belt-like portion 71).

The conventional footwear described above provides a balance exercise for the user by providing the balancing exercising element to intentionally lose his/her balance, which leads the user to a posture different from an ideal posture suitable for sport and the like. So, some of the users may feel difficulty in understanding an ideal posture, which is less efficient for the user to train to be able to assume the ideal posture.

In view of the above, it is an object of the above embodiments to provide a footwear sheet and a footwear that can increase the efficiency at which a user trains to be able to assume an ideal posture.

In order to solve the above-described problem and achieve the object, the 1st aspect of the embodiments provides a footwear sheet to be in contact with the sole surface of a wearer wearing a footwear, including: a sheet-like base part; and a pressure-applying part projected from a side surface of the base part, the pressure-applying part being formed in a planar shape smaller than that of the sole surface of the wearer, wherein the pressure-applying part is provided on a sole-side surface that is a side surface of the side surfaces of the base part facing the sole surface of the wearer, the pressure-applying part being directly in contact with a portion of the sole surface of the wearer such that pressure on the portion of the sole surface of the wearer is higher than pressure on the other portion, enabling the shape of the sole surface of the wearer to be corrected so that the shape of the sole surface of the wearer follows the shape of the pressure-applying part, or is provided on an opposite-side surface that is a side surface of the side surfaces of the base part opposite the sole-side surface, the pressure-applying part being indirectly in contact with a portion of the sole surface of the wearer with the base part in between such that pressure on the portion of the sole surface of the wearer is higher than pressure on the other portion, enabling the shape of the sole surface of the wearer to be corrected so that the shape of the sole surface of the wearer follows the shape of the pressure-applying part.

The 2nd aspect of the embodiments provides the footwear sheet according to the 1st aspect of the embodiments, wherein the pressure-applying part includes a plantar aponeurosis pressure-applying portion placed at the position corresponding to at least a portion of the plantar aponeurosis of the wearer.

The 3rd aspect of the embodiments provides the footwear sheet according to the 1st or 2nd aspect of the embodiments, wherein the pressure-applying part includes a joint pressure-applying portion placed at the position corresponding to at least some joints of the foot of the wearer.

The 4th aspect of the embodiments provides the footwear sheet according to the 3rd aspect of the embodiments, wherein the joint pressure-applying portion is placed at least at the position corresponding to the joint connecting the fifth proximal phalanx and the fifth metatarsal of the wearer or at the position corresponding to at least a portion of the Chopart's joint of the wearer.

The 5th aspect of the embodiments provides the footwear sheet according to any one of the 1st to 4th aspects of the embodiments, wherein a thumb ball pressure-reducing portion in which the pressure-applying part is not provided is formed at the position corresponding to the thumb ball of the wearer.

The 6th aspect of the embodiments provides the footwear sheet according to any one of the 1st to 5th aspects of the embodiments, wherein a heel pressure-reducing portion in which the pressure-applying part is not provided is formed at the position corresponding to the heel of the wearer.

The 7th aspect of the embodiments provides the footwear sheet according to any one of the 1st to 6th aspects of the embodiments, wherein the pressure-applying part includes an arch-of-the-foot pressure-applying portion at the position corresponding to at least a portion of the arch of the foot of the wearer.

The 8th aspect of the embodiments provides the footwear sheet according to any one of the 1st to 7th aspects of the embodiments, wherein a rotational moving-facilitating portion for facilitating rotational moving of the portion of the pressure-applying part corresponding to the phalanx of the wearer and the portion of the pressure-applying part corresponding to the metatarsal of the wearer relative to each other is provided between the two portions.

The 9th aspect of the embodiments provides the footwear sheet according to 8th aspect of the embodiments, wherein the rotational moving-facilitating portion is formed as a groove portion.

The 10th aspect of the embodiments provides the footwear sheet according to 8th aspect of the embodiments, wherein the rotational moving-facilitating portion is formed as a belt-like portion that is more flexible than the portion of the pressure-applying part corresponding to the phalanx of the wearer and the portion of the pressure-applying part corresponding to the metatarsal of the wearer.

The 11th aspect of the embodiments provides the footwear sheet according to any one of the 1st to 10th aspects of the embodiments, wherein the pressure-applying part is removable from the base part.

The 12th aspect of the embodiments provides a pair of the footwear sheets according to any one of the 1st to 11th aspects of the embodiments, wherein the pair of the footwear sheets are stacked on each other such that the respective pressure-applying parts of the pair of the footwear sheets face each other, and the respective base parts of the pair of the footwear sheets are symmetrical with these facing pressure-applying parts as a symmetrical center.

The 13th aspect of the embodiments provides a footwear including the footwear sheet according to any one of the 1st to 12th aspects of the embodiments.

According to the footwear sheet according to the 1st aspect of the embodiments and the 13th aspect of the embodiments, the pressure-applying part is provided on a sole-side surface that is a side surface of the side surfaces of the base part facing the sole surface of the wearer, the pressure-applying part being directly in contact with a portion of the sole surface of the wearer such that pressure on the portion of the sole surface of the wearer is higher than pressure on the other portion, enabling the shape of the sole surface of the wearer to be corrected so that the shape of the sole surface of the wearer follows the shape of the pressure-applying part, or is provided on an opposite-side surface that is a side surface of the side surfaces of the base part opposite the sole-side surface, the pressure-applying part being indirectly in contact with a portion of the sole surface of the wearer with the base part in between such that pressure on the portion of the sole surface of the wearer is higher than pressure on the other portion, enabling the shape of the sole surface of the wearer to be corrected so that the shape of the sole surface of the wearer follows the shape of the pressure-applying part. So, a load can be put on a part of the wearer related to the portion of the sole surface of the wearer corrected by the pressure-applying part, allowing the user to be guided to an ideal posture appropriate for sport and the like, which enables the strength of the lower body muscles for the ideal posture to be improved, and can improve the efficiency in training for the user to be able to assume the ideal posture. Further, when the pressure-applying part is provided on the opposite-side surface of the side surfaces of the base part and the base part is formed of relatively flexible material, a portion other than the portion of the sole surface of the wearer can also be in contact with the base part, so a training can be done so that a balanced, ideal posture can be assumed, which can ensure the stability.

According to the footwear sheet according to the 2nd aspect of the embodiments, the pressure-applying part includes a plantar aponeurosis pressure-applying portion placed at the position corresponding to at least a portion of the plantar aponeurosis of the wearer. So, the plantar aponeurosis pressure-applying portion can apply high pressure on the at least a portion of the plantar aponeurosis, which enables the shape of the sole surface of the wearer to be corrected so that it follows the shape of the plantar aponeurosis pressure-applying portion. This allows, when, for example, the wearer does training such as walking or running, a load to be put on the muscles of the foot located inside of the plantar aponeurosis and allows the muscles of the sole to be corrected so as to be used more strongly than usual, which can increase the amount of movement of the lower body muscles that are not used in the daily life connected to the muscles of the sole, so the strength of the lower body muscles can be further improved.

According to the footwear sheet according to the 3rd aspect of the embodiments, the pressure-applying part includes a joint pressure-applying portion placed at the position corresponding to at least some joints of the foot of the wearer. So, high pressure can be applied on the joints by the joint pressure-applying portion, which enables the shape of the sole surface of the wearer to be corrected so that it follows the shape of the joint pressure-applying portion.

According to the footwear sheet according to the 4th aspect of the embodiments, the joint pressure-applying portion is placed at least at the position corresponding to the joint connecting the fifth proximal phalanx and the fifth metatarsal of the wearer or at the position corresponding to at least a portion of the Chopart's joint of the wearer. So, high pressure can be applied on the joint connecting the fifth proximal phalanx and the fifth metatarsal or at least the portion of the Chopart's joint. Accordingly, when, for example, the wearer swings a baseball bat, a force applied on a pivot foot is unlikely to escape from the fifth metatarsal or the Chopart's joint to the outside, so the instability of the pivot foot can be reduced. Further, a force applied on a foot other than the pivot foot is also unlikely to escape from the fifth metatarsal or the Chopart's joint to the outside of the foot, so the foot can be prevented from opening outwardly.

According to the footwear sheet according to the 5th aspect of the embodiments, a thumb ball pressure-reducing portion in which the pressure-applying part is not provided is formed at the position corresponding to the thumb ball of the wearer. So, the pressure on the thumb ball can be reduced in comparison with the pressure on the portion of the wearer directly or indirectly in contact with the pressure-applying part, which enables the shape of the sole surface of the wearer to be corrected so that it follows the shape of the thumb ball pressure-reducing portion. Accordingly, when, for example, the wearer swings a baseball bat, the wearer becomes pigeon-toed, which facilitates putting muscle into the hip joint, so swing using only hands can be prevented.

According to the footwear sheet according to the 6th aspect of the embodiments, a heel pressure-reducing portion in which the pressure-applying part is not provided is formed at the position corresponding to the heel of the wearer. So, the pressure on the heel can be reduced in comparison with the pressure on the portion of the wearer directly or indirectly in contact with the pressure-applying part, which enables the shape of the sole surface of the wearer to be corrected so that it follows the shape of the heel pressure-reducing portion. Accordingly, for example, when the wearer swings a baseball bat, the wearer becomes pigeon-toed, which facilitates putting muscle into the hip joint, so swing using only hands can be further prevented.

According to the footwear sheet according to the 7th aspect of the embodiments, the pressure-applying part includes an arch-of-the-foot pressure-applying portion at the position corresponding to at least a portion of the arch of the foot of the wearer. So, high pressure can be applied on the at least a portion of the arch of the foot by the arch-of-the-foot pressure-applying portion, which enables the shape of the sole surface of the wearer to be corrected so that it follows the shape of the arch-of-the-foot pressure-applying portion. This allows, when, for example, the wearer does training such as walking or running, the arch of the foot of the wearer to be securely supported, which can improve the stability of the foot and reduce fatigue of the foot.

According to the footwear sheet according to the 8th aspect of the embodiments, a rotational moving-facilitating portion for facilitating rotational moving of the portion of the pressure-applying part corresponding to the phalanx of the wearer and the portion of the pressure-applying part corresponding to the metatarsal of the wearer relative to each other is provided between the two portions. So, when the wearer raises the heel, the toes become able to be bent centering around the joint connecting the phalanx of the wearer and the metatarsal of the wearer. This facilitates effectively holding the ground, allowing the load on the foot to be reduced when, for example, the wearer does training such as walking or running.

According to the footwear sheet according to the 9th aspect of the embodiments, the rotational moving-facilitating portion is formed as a groove portion. So, any special component is not required for forming the rotational moving-facilitating portion, allowing the manufacturing cost of the footwear sheet to be reduced.

According to the footwear sheet according to the 10th aspect of the embodiments, the rotational moving-facilitating portion is formed as a belt-like portion that is more flexible than the portion of the pressure-applying part corresponding to the phalanx of the wearer and the portion of the pressure-applying part corresponding to the metatarsal of the wearer. So, when the wearer is standing, the belt-like portion allows the joint connecting the phalanx of the wearer and the metatarsal of the wearer to be supported to reduce the load on the foot.

According to the footwear sheet according to the 11th aspect of the embodiments, the pressure-applying part is removable from the base part. This allows the pressure-applying part to be attached or removed depending on the use intended by the wearer, thereby improving the usability.

According to the footwear sheet according to the 12th aspect of the embodiments, a pair of the footwear sheets are stacked on each other such that the respective pressure-applying parts of the pair of the footwear sheets face each other, and the respective base parts of the pair of the footwear sheets are symmetrical with these facing pressure-applying parts as a symmetrical center. This allows further increasing the pressure on a portion of the sole surface of the wearer in contact with the pressure-applying part, which further facilitates correcting the shape of the sole surface of the wearer so that it follows the shape of the pressure-applying part. Further, the footwear sheet may be used for any of the right and left foot of the wearer, which allows differentiation of use between the right and left foot depending on the use intended by the wearer.

DESCRIPTION OF REFERENCE NUMERALS AND SIGNS

1 footwear
10 bottom part
20 cover part
30, 30*a*, 30*b*, 130, 230, 330, 430, 530 footwear sheet
40 base part
50 pressure-applying part
51 plantar aponeurosis pressure-applying portion
52, 53 joint pressure-applying portion
54 arch-of-the-foot pressure-applying portion
60 thumb ball pressure-reducing portion
61 heel pressure-reducing portion 61
70 groove portion
71 belt-like portion
80 attaching/removing mechanism
B10 phalanx
B10*a*-B10*e* first phalanx to fifth phalanx
B11 distal phalanx
B11*a*-B11*e* first distal phalanx to fifth distal phalanx
B12 middle phalanx
B12*b*-B12*e* first middle phalanx to fifth middle phalanx
B13 proximal phalanx
B13*a*-B13*e* first proximal phalanx to fifth proximal phalanx
B20 metatarsal
B20*a*-B20*e* first metatarsal to fifth metatarsal
B30 tarsal
B31 medial cuneiform bone
B32 intermediate cuneiform bone
B33 external cuneiform bone
B34 cuboid bone
B35 navicular bone
B36 ankle bone
B37 calcaneal bone
P1, P2 stress distribution
T10 plantar aponeurosis

The invention claimed is:

1. A footwear sheet comprising
a pair of the footwear sheets,
wherein each of the pair of footwear sheets comprises:
a sheet-like base part; and
a pressure-applying part projected from an opposite-side surface of the base part that is opposite a sole-side surface of the base part, the pressure-applying part being formed in a planar shape smaller than that of the sole surface of the wearer, the pressure-applying part being indirectly in contact with a portion of the sole surface of the wearer with the base part in between such that pressure on a portion of the sole surface of the wearer is higher than pressure on another portion of the sole surface of the wearer, another portion being not directly or indirectly in contact with the pressure-applying part with the base part in between;
wherein the pressure-applying part as a whole has a planar shape formed in a longitudinal shape along a direction from a position corresponding to a heel of the wearer to a position corresponding to toes on a foot of the wearer;
wherein the pressure-applying part comprises:
a planar aponeurosis pressure-applying portion placed at a position corresponding to at least a portion of a plantar aponeurosis of the wearer;
a joint pressure-applying portion placed at least at a position corresponding to a joint connecting a fifth proximal phalanx and a fifth metatarsal of the wear or at a position corresponding to at least a portion of a Chopart's joint of the wearer; and
an arch-of-the-foot pressure-applying portion at a position corresponding to at least a portion of an arch of the foot of the wearer;
wherein a thumb ball pressure-reducing portion in which the pressure-applying part is not provided is formed at all areas corresponding to a thumb ball of the wearer;

wherein the pressure-applying part is formed so that a plane shape of pressure-applying part is curved in the joint pressure-applying portion and the arch-of-the-foot pressure-applying portion and not passing through the thumb ball pressure-reducing portion;

wherein the plane shape of the pressure-applying part is a shape along a direction parallel to the sole surface of the wearer; and wherein the plane shape of the pressure-applying part is a shape in which the plantar aponeurosis pressure-applying portion, the join pressure-applying portion and the arch-of-the-foot pressure-applying portion are continuous with each other;

wherein the pair of the footwear sheets are stacked on each other such that the respective pressure-applying parts of the pair of the footwear sheets face each other, and the respective base parts of the pair of the footwear sheets are symmetrical with these facing pressure-applying parts as a symmetrical center.

2. A footwear comprising the footwear sheet according to claim 1.

3. A footwear sheet to be in contact with a sole surface of a wearer-wearing a footwear, comprising:

a sheet-like base part; and a pressure-applying part projected from an opposite-side surface of the base part that is opposite a sole-side surface of the base part, the pressure-applying part being formed in a planar shape smaller than that of the sole surface of the wearer, the pressure-applying part being indirectly in contact with a portion of the sole surface of the wearer with the base part in between such that pressure on a portion of the sole surface of the wearer is higher than pressure on another portion of the sole surface of the wearer, another portion being not directly or indirectly in contact with the pressure-applying part with the base part in between;

wherein the pressure-applying part as a whole has a planar shape formed in a longitudinal shape along a direction from a position corresponding to a heel of the wearer to a position corresponding to toes on a foot of the wearer;

wherein the pressure-applying part comprises:

a planar aponeurosis pressure-applying portion placed at a position corresponding to at least a portion of a plantar aponeurosis of the wearer;

a joint pressure-applying portion placed at least at a position corresponding to a joint connecting a fifth proximal phalanx and a fifth metatarsal of the wear or at a position corresponding to at least a portion of a Chopart's joint of the wearer; and an arch-of-the-foot pressure-applying portion at a position corresponding to at least a portion of an arch of the foot of the wearer;

wherein a thumb ball pressure-reducing portion in which the pressure-applying part is not provided is formed at all areas corresponding to a thumb ball of the wearer;

wherein the pressure-applying part is formed so that a plane shape of pressure-applying part is curved in the joint pressure-applying portion and the arch-of-the-foot pressure-applying portion and not passing through the thumb ball pressure-reducing portion;

wherein the plane shape of the pressure-applying part is a shape along a direction parallel to the sole surface of the wearer; and wherein the plane shape of the pressure-applying part is a shape in which the plantar aponeurosis pressure-applying portion, the join pressure-applying portion and the arch-of-the-foot pressure-applying portion are continuous with each other;

wherein the base part has a cross sectional shape orthogonal to a direction from the heel to the toe of the wearer, the cross sectional shape being curved so that a portion of the base part corresponding to the plantar aponeurosis of the wearer is located closest to the sole surface of the wearer with respect to the other portion of the base part.

4. A footwear comprising the footwear sheet according to claim 3.

* * * * *